US007536126B2

(12) United States Patent
Kawakami et al.

(10) Patent No.: US 7,536,126 B2
(45) Date of Patent: May 19, 2009

(54) APPARATUS FOR FORMING IMAGE-QUALITY EVALUATION IMAGE

(75) Inventors: Takayuki Kawakami, Nagano-ken (JP); Takashi Hama, Nagano-ken (JP); Takatomo Fukumoto, Nagano-ken (JP); Yoichi Yamada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 249 days.

(21) Appl. No.: 11/150,884

(22) Filed: Jun. 9, 2005

(65) Prior Publication Data

US 2005/0281572 A1 Dec. 22, 2005

(30) Foreign Application Priority Data

| | | |
|---|---|---|
| Jun. 16, 2004 | (JP) | 2004-178674 |
| Jun. 16, 2004 | (JP) | 2004-178675 |
| Jun. 16, 2004 | (JP) | 2004-178676 |
| Jun. 16, 2004 | (JP) | 2004-178677 |
| Jun. 16, 2004 | (JP) | 2004-178678 |
| Mar. 2, 2005 | (JP) | 2005-057357 |

(51) Int. Cl.
*G03G 15/00* (2006.01)

(52) U.S. Cl. ..... 399/49; 399/72

(58) Field of Classification Search ..... 399/15, 399/49, 72, 24, 309, 401, 402
See application file for complete search history.

(56) References Cited

U.S. PATENT DOCUMENTS

| | | | |
|---|---|---|---|
| 5,502,550 | A | 3/1996 | Hori et al. |
| 6,181,888 | B1 | 1/2001 | Scheuer et al. |
| 6,205,301 | B1 | 3/2001 | Shigeta et al. |
| 6,243,542 | B1 | 6/2001 | Fujimoto et al. |
| 6,268,932 | B1 | 7/2001 | Lee et al. |
| 6,337,958 | B1 | 1/2002 | Stanich et al. |
| 6,490,421 | B2 | 12/2002 | McIntyre |
| 6,556,793 | B2 * | 4/2003 | Nakamura ..... 399/15 |

(Continued)

FOREIGN PATENT DOCUMENTS

| | | |
|---|---|---|
| EP | 0837372 A2 | 4/1998 |

(Continued)

OTHER PUBLICATIONS

European partial Search Report for corresponding European application No. 05012746.3-2209 lists the reference above.

(Continued)

*Primary Examiner*—Hoang Ngo
(74) *Attorney, Agent, or Firm*—Hogan & Hartson LLP

(57) ABSTRACT

A test pattern P3 longer than a length Ld corresponding to a circumferential length of a developing roller is formed along a moving direction of a photosensitive member (or developing roller). The developing roller transports a great quantity of toner on its surface in a first revolution thereof and hence, the test pattern has a high density. When the residual toner runs low, the toner transport quantity is decreased in the subsequent revolution, so that the test pattern P3 is decreased in the density at its portion beyond the length Ld from its head. If a density difference is observed at place corresponding to a boundary between image portions formed in the first revolution and the second revolution, it is concluded that image quality is degraded due to the shortage of residual toner.

15 Claims, 29 Drawing Sheets

U.S. PATENT DOCUMENTS

| | | | | |
|---|---|---|---|---|
| 6,726,302 | B2 | 4/2004 | Yamada | |
| 6,961,526 | B2 * | 11/2005 | Tezuka et al. | 399/15 |
| 7,062,185 | B2 | 6/2006 | Izumikawa et al. | |
| 2002/0110380 | A1 | 8/2002 | McIntyre | |
| 2003/0085940 | A1 | 5/2003 | Yamada | |
| 2003/0138261 | A1 | 7/2003 | Tezuka et al. | |
| 2005/0141907 | A1 | 6/2005 | Izumikawa et al. | |

FOREIGN PATENT DOCUMENTS

| | | | |
|---|---|---|---|
| JP | 7-140769 | | 6/1995 |
| JP | 8-160696 | | 6/1996 |
| JP | 8-160704 | | 6/1996 |
| JP | 9-27879 | | 1/1997 |
| JP | 09066650 | | 3/1997 |
| JP | 09066650 | A | 3/1997 |
| JP | 10-123820 | | 5/1998 |
| JP | 11-119481 | | 4/1999 |
| JP | 11-184181 | | 7/1999 |
| JP | 11-184190 | | 7/1999 |
| JP | 11-231736 | | 8/1999 |
| JP | 2001-109222 | | 4/2001 |
| JP | 2001-136399 | | 5/2001 |
| JP | 2001-144987 | | 5/2001 |
| JP | 2001-201905 | | 7/2001 |
| JP | 2002-62713 | | 2/2002 |
| JP | 2002-0196628 | | 7/2002 |
| JP | 2002-251042 | | 9/2002 |
| JP | 2003-15376 | | 1/2003 |
| JP | 2003323026 | A | 11/2003 |
| JP | 2004-69833 | | 3/2004 |

OTHER PUBLICATIONS

European Search Report for corresponding European application 05012746.3-2209 lists the references above, Jul. 2, 2008.

* cited by examiner

FIG. 4A : GREAT RESIDUAL QUANTITY OF TONER
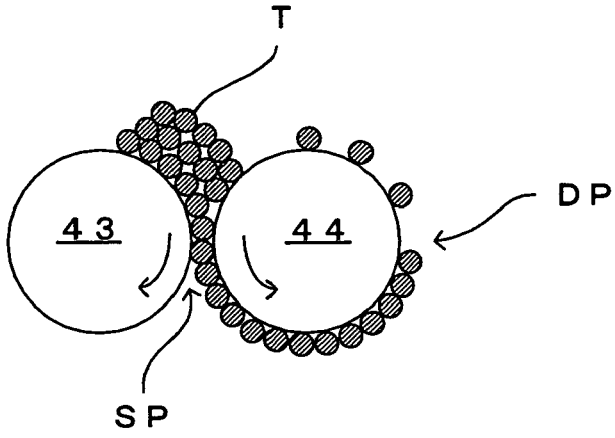
FIG. 4B : DECREASED RESIDUAL QUANTITY OF TONER: FIRST REVOLUTION
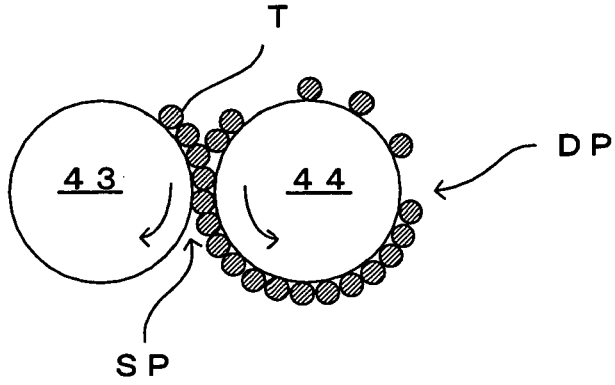
FIG. 4C : FURTHER DECREASED RESIDUAL QUANTITY OF TONER: SECOND REVOLUTION
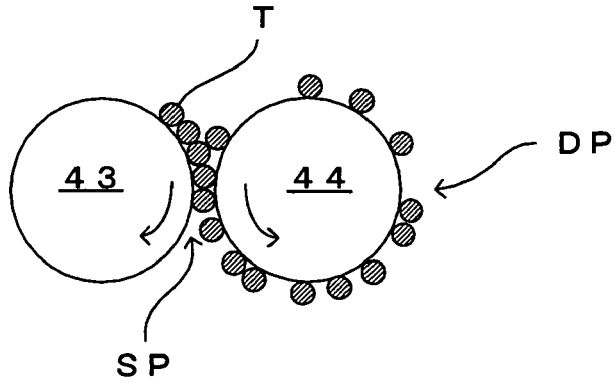

FIG. 19

| TO-BE-CHECKED TONER COLOR | OPTIONAL BACKGROUND TONER COLOR |
|---|---|
| Y (YELLOW) | M, C, K |
| M (MAGENTA) | C, K |
| C (CYAN) | K |

FIG. 23

| TO-BE-CHECKED TONER COLOR | OPTIONAL BACKGROUND TONER COLOR |
|---|---|
| Y (YELLOW) | M, C, K |
| M (MAGENTA) | Y |
| C (CYAN) | Y |
| K (BLACK) | Y |

FIG. 26

| CYAN COLOR / MAGENTA COLOR | PRIOR-TO NEAR-END | SUBSEQUENT-TO NEAR-END |
|---|---|---|
| PRIOR-TO NEAR-END | CYAN | MAGENTA |
| SUBSEQUENT-TO NEAR-END | CYAN | EITHER OF CYAN AND MAGENTA THAT IS GREATER IN RESIDUAL QUANTITY |

APPARATUS FOR FORMING IMAGE-QUALITY EVALUATION IMAGE

CROSS REFERENCE TO RELATED APPLICATION

The disclosure of Japanese Patent Applications enumerated below including specification, drawings and claims is incorporated herein by reference in its entirety:

No. 2004-178674 filed Jun. 16, 2004;
No. 2004-178675 filed Jun. 16, 2004;
No. 2004-178676 filed Jun. 16, 2004;
No. 2004-178677 filed Jun. 16, 2004;
No. 2004-178678 filed Jun. 16, 2004; and
No. 2005-057357 filed Mar. 2, 2005.

BACKGROUND OF THE INVENTION

1. Field of the Invention

The present invention relates to a technique for forming an image-quality evaluation image in an apparatus for forming an image with toner.

2. Description of the Related Art

In image forming apparatuses for forming an image with toner, such as printers, copiers and facsimiles, the following problem is encountered. As the apparatus is used longer, image quality is degraded due to the changes of apparatus conditions such as deterioration of the apparatus or low residual quantity of toner. If image formation is immediately inhibited in response to such an occasion, further degradation of the image quality may be prevented. However, there may be a case where a user wants to continue to form images even though the image quality is lowered more or less. In order to meet such a demand, a printing apparatus disclosed in Japanese Unexamined Patent Publication No. 2002-196628, for example, takes the following procedure. When the residual toner quantity becomes less than a first predetermined value, the apparatus warns the user by displaying a message about the possibility of producing some streaking, fading or the like in prints. In the meantime, the apparatus carries out at least the ongoing processing on print job data according to button operation made by the user, so as to output the resultant prints. In this manner, the apparatus is capable of meeting the above user demand and accomplishing enhanced user convenience.

SUMMARY OF THE INVENITON

An acceptable level of the degraded image quality varies depending upon user's intention or upon the types of images. It is therefore desirable to permit the user to judge the image quality in the end. In order to realize this, it may be contemplated to form a suitable test pattern for image-quality evaluation on a recording medium such as paper and to output the resultant print. However, it is not always easy for general users having little specialized knowledge to evaluate the image quality by visual inspection. It is therefore desired to devise the image pattern to be outputted for the purpose of the image-quality evaluation, so as to establish a technique enabling the user having little specialized knowledge to judge the image quality easily. Unfortunately, adequate studies have not heretofore been made on such a technique.

A primary object of the invention is to provide an image forming apparatus and method providing easy judgment of the image quality by producing the image-quality evaluation image which is easier to inspect visually.

In fulfillment of the foregoing object, an apparatus and a method are provided and are particularly well suited to a technique for forming an image-quality evaluation image. In a first aspect of the present invention, an image is formed with toner carried on a toner carrier in a first revolution of the toner carrier, so that the toner carried on a predetermined region of a surface of the toner carrier is consumed. Then, at least a part of the image-quality evaluation image is formed by using the toner carried on the predetermined surface region of the toner carrier in a second revolution following the first revolution of the toner carrier. Such the image-quality evaluation image is prone to the degraded image quality associated with the shortage of residual toner. Hence, the user may readily judge the image quality by observing the status sheet thus obtained.

According to a second aspect of the present invention, an image-quality evaluation image includes: a band-like pattern having a uniform image pattern extending along a moving direction of a surface of a toner carrier with respect to the opposed position; and scale-mark patterns arranged near the band-like pattern as spaced at predetermined space intervals along the moving direction. Therefore, a user can correctly check the quality of an image.

According to a third aspect of the present invention, an image forming unit forms an image-quality evaluation image on a first primary side of a recording medium, and forms a background image on a second primary side opposite from the first primary side of the recording medium at place corresponding to the image-quality evaluation image. Since the density difference is enhanced by forming the images on the both sides of the recording medium, even the general users having little specialized knowledge can visually recognize the density difference with ease.

According to a fourth aspect of the present invention, an image-quality evaluation image is formed with a to-be-checked toner color on a recording medium. Particularly, a color-mixture image having a mixed color of the to-be-checked toner color and one of toner colors for mixing is formed as the image-quality evaluation image, the toner colors including the plural toner colors except the to-be-checked toner color. The density variations of the to-be-checked toner image appear as the color irregularities in the color-mixture image. As a result, a user can judge the quality of the to-be-checked toner image by evaluating the degree of the color irregularities on the color-mixture image.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 4A to 4C are schematic diagrams each showing a surface condition of the developing roller;

FIG. 19 is a chart showing the toner colors of the image-quality evaluation image and the background image;

FIG. 23 is a chart showing the toner colors of the image-quality evaluation image and the background image;

FIG. 26 is a chart illustrating a method of deciding the toner color for mixing;

DETAILED DESCRIPTION OF THE PREFERRED EMBODIMENTS

First Embodiment

Figure 1:
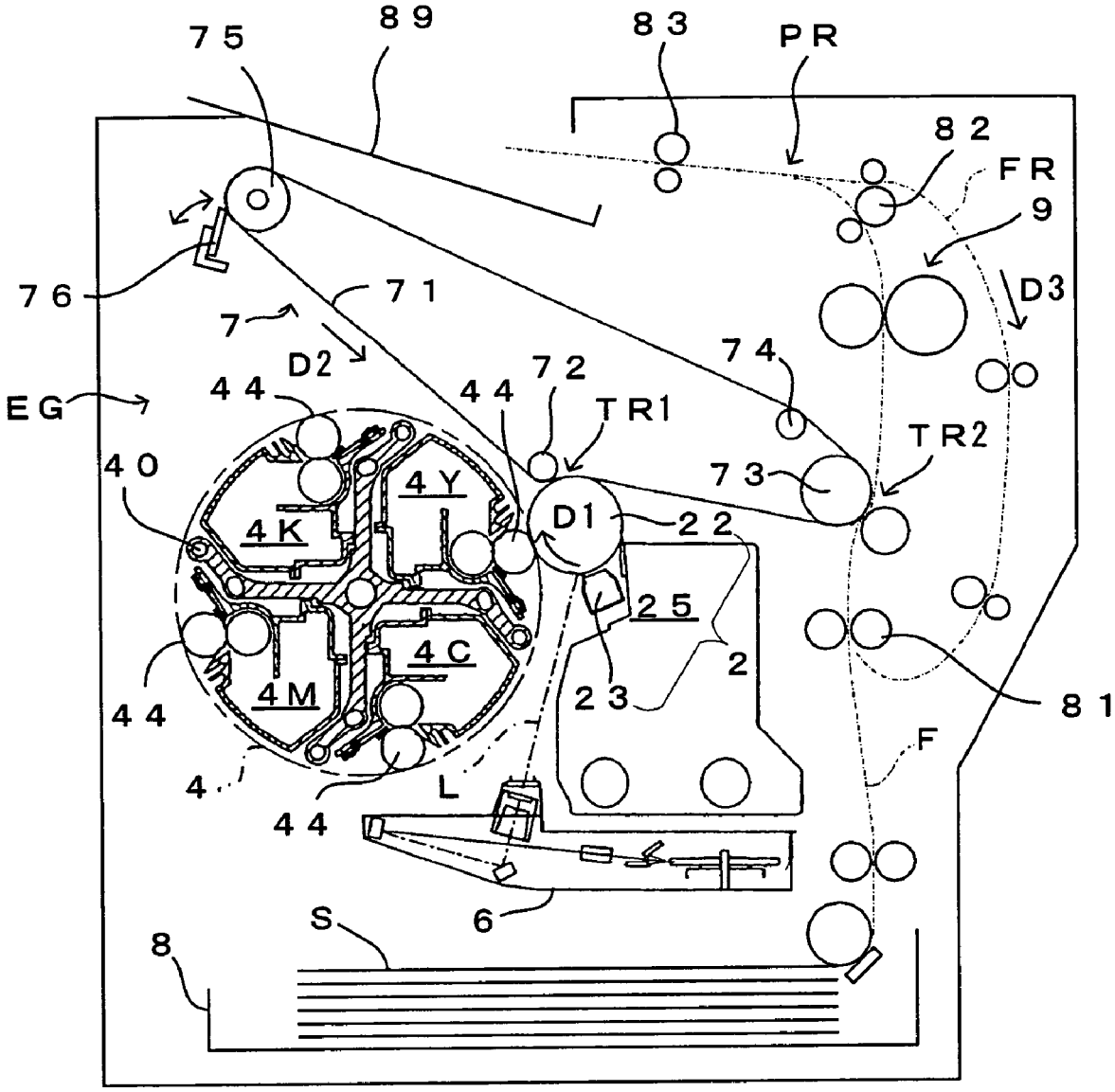
FIG. 1 is a drawing which shows the structure of an image forming apparatus according to the present invention.
Figure 2:
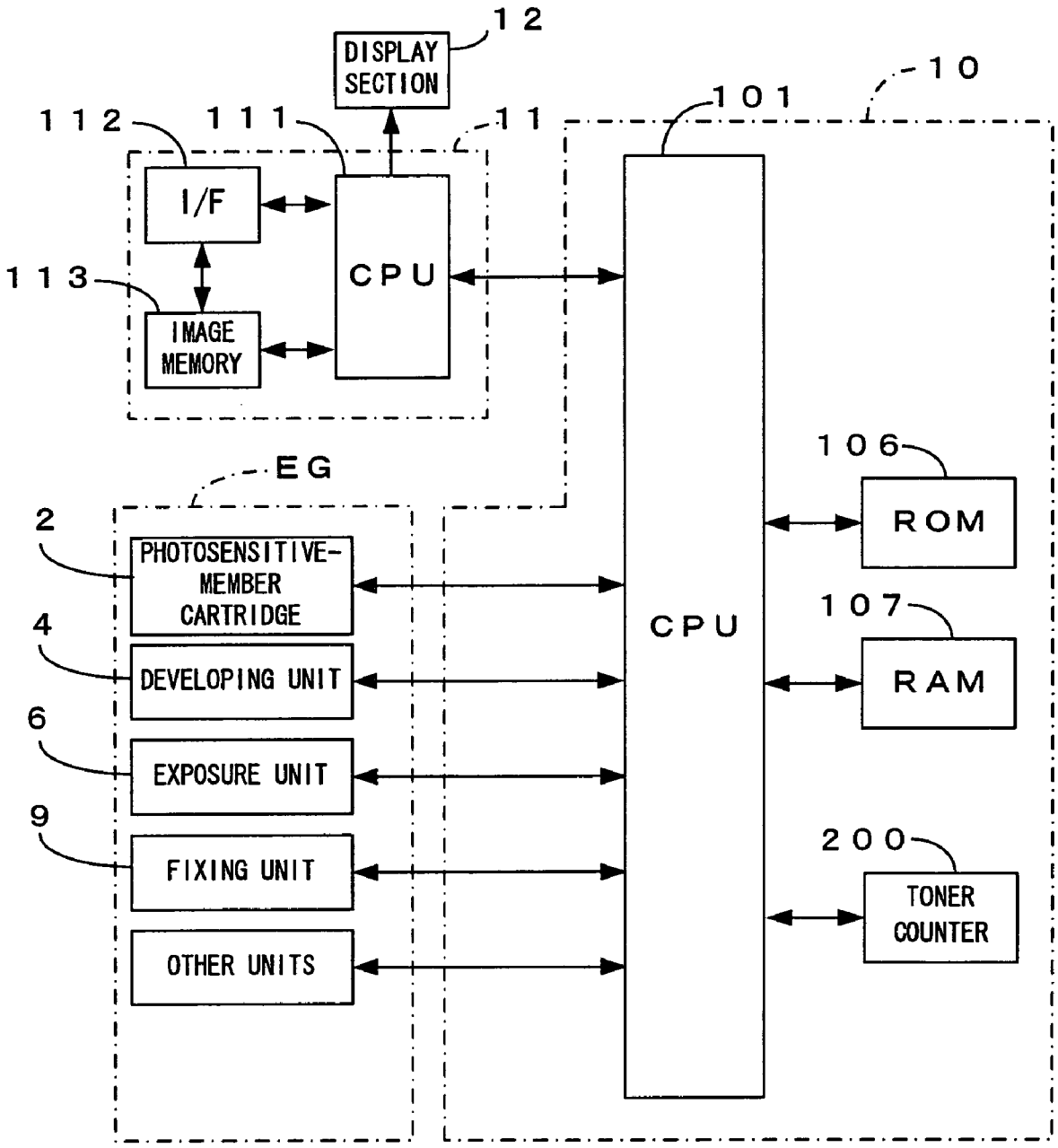
FIG. 2 is a block diagram of the electric structure of the image forming apparatus which is shown in FIG. 1.

FIG. 1 is a drawing which shows the structure of an image forming apparatus according to the present invention. FIG. 2 is a block diagram of the electric structure of the image forming apparatus which is shown in FIG. 1. The illustrated apparatus is an apparatus which overlays toner in four colors of yellow (Y), cyan (C), magenta (M) and black (K) one atop the other and accordingly forms a full-color image, or forms a monochrome image using only black toner (K). In the image forming apparatus, when an image signal is fed to a main controller 11 from an external apparatus such as a host computer, a predetermined image forming operation is performed. That is, an engine controller 10 controls respective portions of an engine part EG in accordance with an instruction received from the main controller 11, and an image which corresponds to the image signal is formed on a sheet S.

In the engine part EG, a photosensitive member 22 is disposed so that the photosensitive member 22 can freely rotate in the arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a used toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from a main section of the apparatus as one integrated unit.

An exposure unit 6 emits a light beam L toward the outer circumferential surface of the photosensitive member 22 which is thus charged by the charger unit 23. The exposure unit 6 makes the light beam L expose on the photosensitive member 22 in accordance with an image signal fed from the external apparatus and forms an electrostatic latent image which corresponds to the image signal.

The developer unit 4 develops thus formed electrostatic latent image with toner. The developer unit 4 comprises a support frame 40 which is disposed for free rotations about a rotation shaft which is perpendicular to the plane of FIG. 1, and also comprises a yellow developer 4Y, a cyan developer 4C, a magenta developer 4M and a black developer 4K which house toner of the respective colors and are formed as cartridges which are freely attachable to and detachable from the support frame 40. The engine controller 10 controls the developer unit 4. The developer unit 4 is driven into rotations based on a control instruction from the engine controller 10. When the developers 4Y, 4C, 4M and 4K are selectively positioned at a predetermined developing position which abuts on the photosensitive member 22 or is away a predetermined gap from the photosensitive member 22, toner of the color corresponding to the selected developer is supplied onto the surface of the photosensitive member 22 from a developer roller 44 disposed to the selected developer which carries toner of this color and has been applied with the predetermined developing bias. As a result, the electrostatic latent image on the photosensitive member 22 is visualized in the selected toner color.

Figure 3:
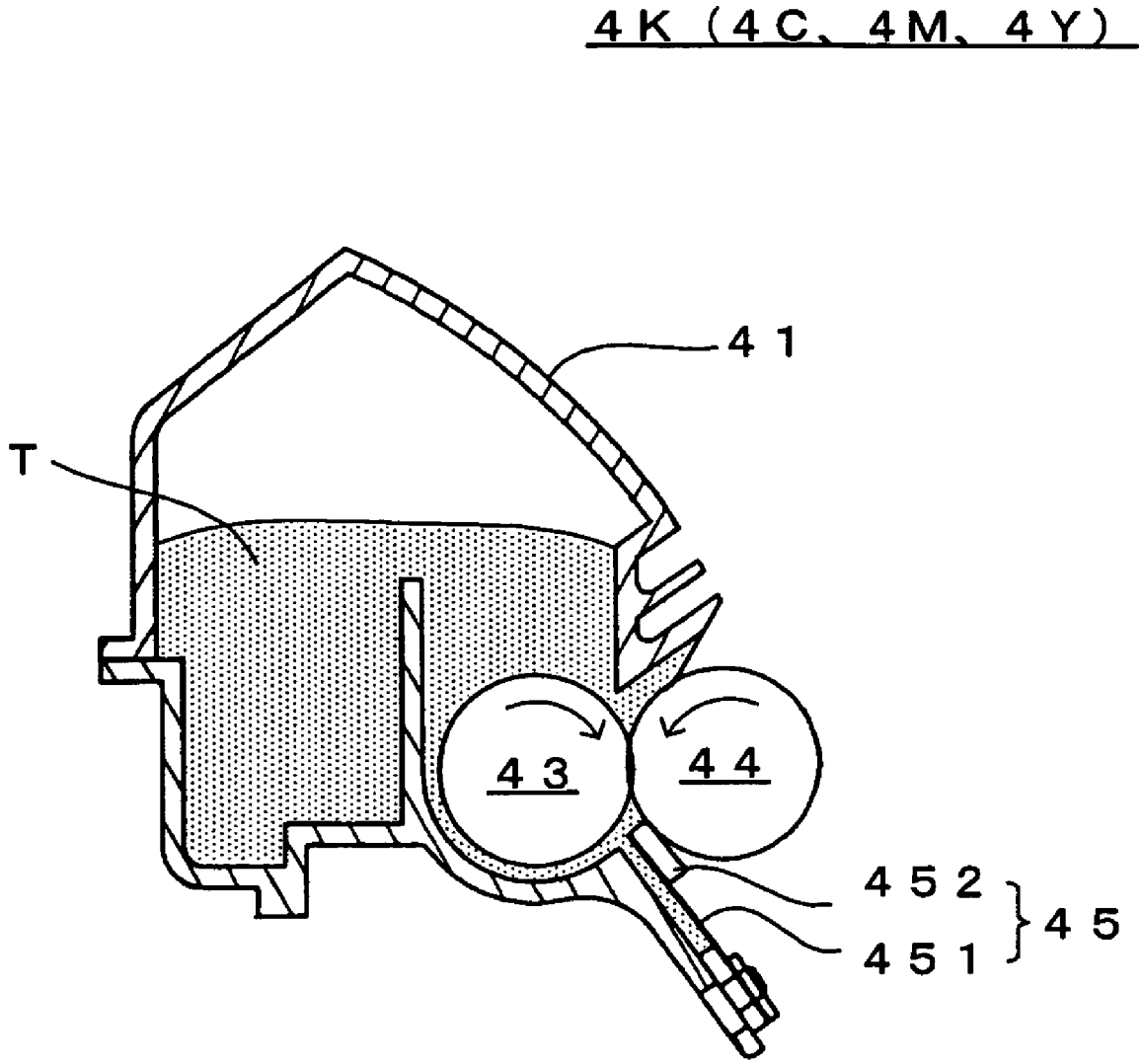
FIG. 3 is a cross sectional view of the developer of the image forming apparatus.

FIG. 3 is a cross sectional view of the developer of the image forming apparatus. Since the developers 4Y, 4C, 4M and 4K all have the same structure, a structure of the developer 4K will now be described in more detail with reference to FIG. 3. The other developers 4Y, 4C and 4M remain the same in structure and function. In this developer 4K, a supply roller 43 and a developer roller 44 are axially attached to a housing 41 which houses toner T inside. As the developer 4K is positioned at the developing position described above, the developer roller 44 abuts on the photosensitive member 2 or gets positioned at an opposed position with a predetermined gap from the photosensitive member 2, and the rollers 43 and 44 rotate in a predetermined direction as they are engaged with the rotation driver (not shown) which is disposed to the main section. The developer roller 44 is made as a cylinder of metal, such as iron, copper and aluminum, or an alloy such as stainless steel, or so as to receive a developing bias as described later. As the two rollers 43 and 44 rotate while remaining in contact, the black toner is rubbed against a surface of the developer roller 44 and a toner layer having predetermined thickness is accordingly formed on the surface of the developer roller 44.

Further, in the developer 4K, a restriction blade 45 is disposed to restrict the thickness of the toner layer formed on the surface of the developer roller 44 into the predetermined thickness. The restriction blade 45 comprises a plate-like member 451 of stainless steel, phosphor bronze or the like and an elastic member 452 of rubber, a resin material or the like attached to a front edge of the plate-like member 451. A rear edge of the plate-like member 451 is fixed to the housing 41, which ensures that the elastic member 452 attached to the front edge of the plate-like member 451 is positioned on the upstream side to the rear edge of the plate-like member 451 in a rotation direction of the developer roller 44. The elastic member 452 elastically abuts on the surface of the developer roller 44, thereby restricting the toner layer formed on the surface of the developer roller 44 finally into the predetermined thickness.

The toner layer thus formed on the surface of the developer roller 44 is gradually transported, owing to the rotations of the developer roller 44, to an opposed position facing the photosensitive member 2 on which surface the electrostatic latent image has been formed. As the developing bias from the engine controller 10 is applied upon the developer roller 44, the toner carried on the developer roller 44 partially adheres to respective portions within the surface of the photosensitive member 2 in accordance with surface potentials in these portions. The electrostatic latent image on the surface of the photosensitive member 2 is visualized as a toner image in this toner color in this manner.

A toner image developed by the developer unit 4 in the manner above is primarily transferred onto an intermediate transfer belt 71 of a transfer unit 7 in a primary transfer region TR1. The transfer unit 7 comprises the intermediate transfer belt 71 which runs across a plurality of rollers 72 through 75, and a driver (not shown) which drives a roller 73 into rotations to thereby rotate the intermediate transfer belt 71 along a predetermined rotation direction D2. For transfer of a color image on the sheet S, toner images in the respective colors on the photosensitive member 22 are superposed one atop the other on the intermediate transfer belt 71, thereby forming a color image. Further, on the sheet S unloaded from a cassette 8 one at a time and transported to a secondary transfer region TR2 along a transportation path F, the color image is secondarily transferred.

At this stage, for the purpose of correctly transferring the image held by the intermediate transfer belt 71 onto the sheet S at a predetermined position, the timing of feeding the sheet S into the secondary transfer region TR2 is managed. To be more specific, there is a gate roller 81 disposed in front of the secondary transfer region TR2 on the transportation path F. As the gate roller 81 rotates in synchronization to the timing of rotations of the intermediate transfer belt 71, the sheet S is fed into the secondary transfer region TR2 at predetermined timing.

Further, the sheet S now bearing the color image is transported to a discharge tray 89, which is disposed to a top surface of the main section of the apparatus, through a fixing unit 9, a pre-discharge roller 82 and a discharge roller 83. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction along a reverse transportation path FR. While the sheet S is returned back to the transportation path F again before arriving at the gate roller 81, the surface of the sheet S which abuts on the intermediate transfer belt 71 in the secondary transfer region TR2 and is to receive a transferred image is at this stage opposite to the surface which already bears the image. In this fashion, it is possible to form images on the both surfaces of the sheet S.

Further, there is a cleaner 76 in the vicinity of the roller 75. The cleaner 76 can be attached to and detached from the intermediate transfer belt 71. When abutting on the intermediate transfer belt 71 as needed, the cleaner 76 scrapes off the toner remaining on the intermediate transfer belt 71 and the toner which constitutes the patch image.

Further, as shown in FIG. 2, the apparatus comprises a display 12 which is controlled by a CPU 111 of the main controller 11. The display 12 is formed by a liquid crystal display for instance, and shows predetermined messages which are indicative of operation guidance for a user, a progress in the image forming operation, abnormality in the apparatus, the timing of exchanging any one of the units, etc.

In FIG. 2, denoted at 113 is an image memory which is disposed to the main controller 11, so as to store an image which is fed from an external apparatus such as a host computer via an interface 112. Denoted at 106 is a ROM which stores a calculation program executed by the CPU 101, control data for control of the engine part EG, etc. Denoted at 107 is a memory (RAM) which temporarily stores a calculation result derived by the CPU 101, other data, etc.

A reference numeral 200 represents a toner counter for determining toner consumption. The toner counter 200 calculates and stores a quantity of toner of each color consumed in conjunction with the execution of the image forming operation. The method of calculating the toner consumption is optional and any of the various known techniques may be used. For instance, the image signal inputted from the external apparatus may be analyzed to count the number of formed toner dots on a per-toner-color basis, so as to calculate the toner consumption form the count value.

The CPU 101 figures out the residual quantity of toner in each of the developers 4Y and such at each point of time by subtracting the per-color toner consumption determined by the toner counter 200 from the initial quantity of toner stored in each developer. As required, the CPU causes the display section 12 to display a message informing the user of the per-color residual toner quantity or of the occurrence of toner end.

Specifically, in a case where the residual quantity of toner in any of the developers is below a predetermined reference value, a message is displayed indicating that time to replace the developer of the toner color in question draws near (hereinafter, referred to as "near-end message"). The reference value in this case is set to a value such that a certain image quality may be maintained if the image forming operation is performed with the residual toner quantity decreased to this reference value. By displaying the near-end message, the user is given time allowance for preparing a new developer before a seriously degraded image quality results from toner end.

When the residual toner quantity is further decreased to a level that the image quality is supposed to be degraded seriously, the CPU 101 displays a message prompting the user to replace the developer (hereinafter, referred to as "end message") and inhibits the subsequent image forming operation. By doing so, the CPU 101 prevents the formation of an image seriously degraded in image quality. However, in order to meet a demand of a user wanting to use up the greatest possible quantity of toner in the developer or a user wanting to form images as allowing for the degraded image quality, an alternative arrangement may be made such that the user may manipulate the apparatus to cancel this inhibition.

During a time period between the display of the near-end message and the display of the end message, the possibility of the image quality degradation is progressively increased as the residual toner quantity decreases. To what degree the degradation of image quality is allowed varies depending upon what the user desires or the types of images to be formed. It is therefore impossible to decide a univocal replacement of the developer on the basis of the residual toner quantity. According to the embodiment, therefore, if the user demands it after the display of the near-end message, a status sheet containing an image of a predetermined pattern is outputted such that the user may check the image quality.

Now, description will be made on the image pattern formed on the status sheet according to the embodiment. In this embodiment, a single status sheet contains the following image segments in order to provide the user with easy visual recognition of the degraded image quality associated with the low residual toner quantity. The image segments include: an image segment formed using the toner carried on a region of a surface of the developing roller 44, the surface region having the toner thereon consumed for the image formation during the preceding revolution of the developing roller; and an image segment formed using the toner carried on a surface region of the developing roller 44, the region holding the toner unconsumed for the image formation during the preceding revolution. The reason for forming such image segments is specifically described as below.

FIGS. 4A to 4C are schematic diagrams each showing a surface condition of the developing roller 44. First, consider a case where a sufficient quantity of toner is contained in the developer. In this case, as shown in FIG. 4A, a great quantity of toner particles exist in the vicinity of a toner supply position SP where the supply roller 43 and the developing roller 44 are positioned in opposed relation. The toner rubbed on the surface of the developing roller 44 at the supply position SP is transported by the revolving developing roller 44 to a development position DP where the developing roller opposes the photosensitive member 22. At the development position DP, a part of the toner is transferred to the photosensitive member 22 thereby visualizing the electrostatic latent image on the photosensitive member 22. As a result, the density of the toner on the surface of the developing roller 44 temporarily becomes lower on the downstream side from the development position DP with respect to the rotational direction of the developing roller 44 than on the upstream side from the development side DP. However, the developing roller 44 is further rotated so that fresh toner T is supplied to the surface of the roller at the supply position SP. Accordingly, a consistent quantity of toner is transported from the supply position SP to the development position DP. Consequently, the formed image also has a stable density.

Next, consider a case where the residual toner in the developer runs low. When the image forming operation is started, the developing roller starts revolving. The developing roller 44 makes several revolutions before the toner on the surface of the developing roller is actually used for the image formation. During these revolutions, the toner drawing to toner end in the developer is gathered up on the surface of the developing roller 44. Hence, as shown in FIG. 4B, a certain quantity of toner is carried on the developing roller 44. As to an image formed using the toner carried on the developing roller 44 at this point of time, therefore, it is possible to achieve an original density or a density close to the original density.

However, after the toner is consumed at the development position DP, the toner refurnished to the roller at the supply position SP is so little that quite a low quantity of toner is transported to the development position DP by the developing roller 44 making the subsequent revolution, as shown in FIG. 4C. Furthermore, when the quantity of toner transported by the developing roller 44 is decreased, the charge of the toner is increased due to abrasion between the supply roller 43 and the regulator blade 45. During this revolution of the roller, the quantity of toner transferred from the developing roller 44 to the photosensitive member 22 for the image formation is so little because of these factors that the image defects, such as poor image density, streaking, fading and density variations, are likely to occur.

In a case where the image forming operation is performed with the developing roller 44 rotated through two revolutions, an image formed in the first revolution of the roller achieves a relatively high image density whereas an image formed in the second revolution of the roller tends to suffer the image defects such as poor image density, streaking or fading. To determine whether the actual image forming operation forms a defective image or not, therefore, it is preferred to make judgment based on the quality of the image formed in the second revolution of the developing roller 44 as described above. In other words, the image pattern (test pattern) formed on the status sheet for image quality evaluation may desirably contain the aforementioned image formed in the second revolution of the developing roller 44.

Figure 5:
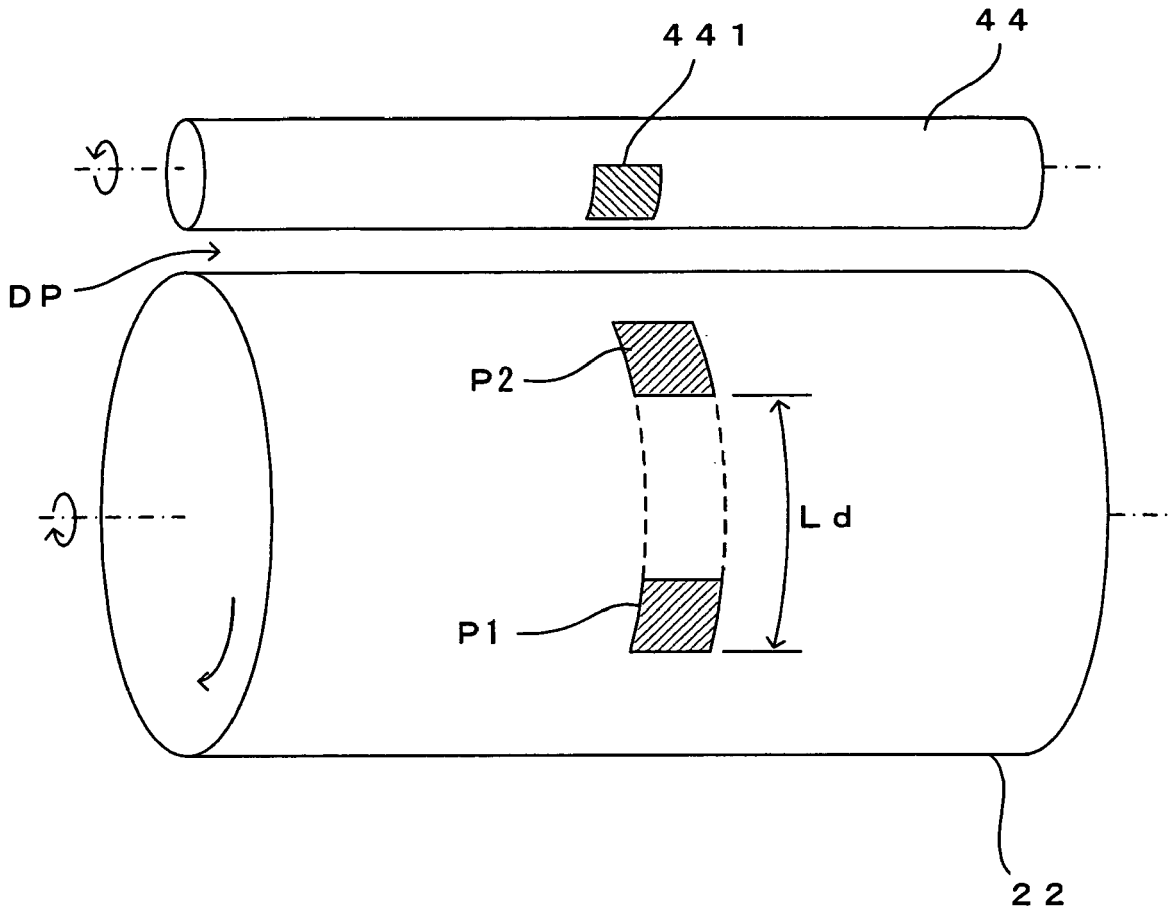
FIG. 5 is a principle diagram for explaining density differences in the test pattern.
Figure 6:
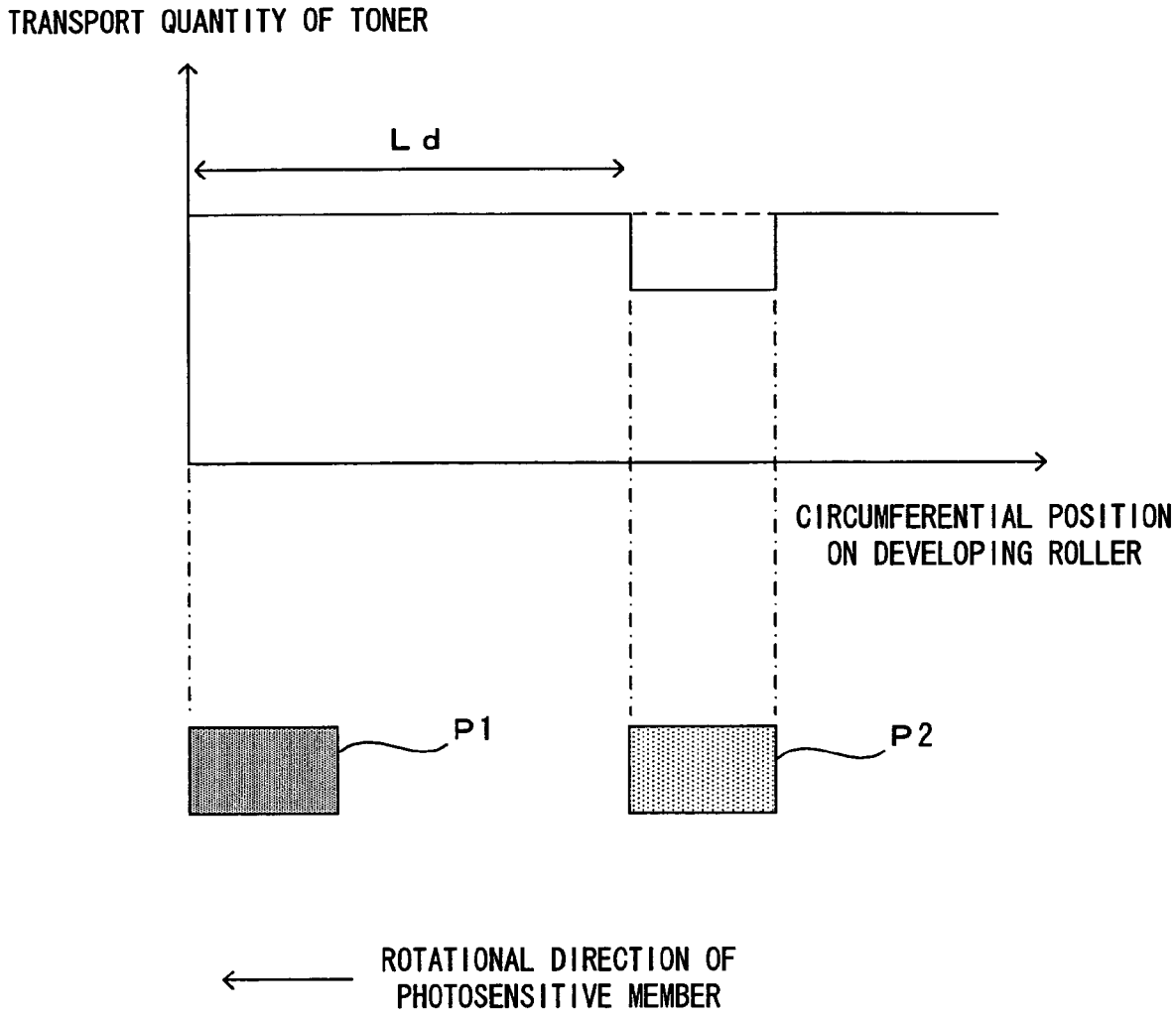
FIG. 6 is a chart showing the transport quantity of toner and the density of the test pattern.

FIG. 5 is a principle diagram for explaining density differences in the test pattern. FIG. 6 is a chart showing the transport quantity of toner and the density of the test pattern. Consider a case where the image forming operation is performed using the toner carried on a partial region 441 of the surface of the developing roller while the developing roller 44 equipped with the developer having a low residual quantity of toner is revolved in a direction of an arrow of FIG. 5. At this time, an image pattern P1 firstly formed on the photosensitive member 22 has a sufficient image density because the pattern is visualized using the toner previously carried on the developing roller 44. On the other hand, an image pattern P2 is visualized using the toner carried on the same surface region 441 of the developing roller 44 making the subsequent revolution. The toner carried on the region during the preceding revolution of the roller is consumed for forming the image pattern P1. Further, a smaller quantity of toner is refurnished to the developing roller. As a result, the image pattern P2 has a lower density than the image pattern P1. Starting positions for forming the image patterns P1 and P2 are spaced from each other by a length Ld corresponding to the circumferential length of the developing roller 44. It is noted here that "the length corresponding to the circumferential length" is a length for which the surface of the photosensitive member 22 is moved during one revolution of the developing roller 44. If the moving speeds (circumferential speeds) of the surfaces of the developing roller 44 and the photosensitive member 22 are the same, the length Ld is equal to the circumferential length of the developing roller 44. If the individual circumferential speeds are different, on the other hand, the length Ld is determined by multiplying the circumferential length of the developing roller 44 by a ratio of the circumferential speed of the developing roller 44 to the circumferential speed of the photosensitive member 22 (circumferential speed ratio).

If an image including these two image patterns P1 and P2 is formed on the status sheet, the image quality may be readily evaluated by determining whether a density difference between these patterns is at a visually recognizable level or not. Particularly if these image patterns are arranged in mutually adjoining relation, the image quality may be judged based on whether a density difference at a boundary area between these image patterns is visually recognizable or not. That is, if there is no recognizable density difference between these patterns, it is expected that images successively formed with the developing roller 44 rotated through several revolutions will have unrecognizable density variations. If there is a recognizable density difference between these patterns, on the other hand, it is expected that the successively formed images will suffer density variations. These image patterns P1 and P2 are equivalent to "reference image segment" and "evaluative image segment" of the invention, respectively.

The pattern P1 equivalent to the reference image segment may preferably be a solid image such as to consume the greatest possible quantity of toner on the surface of the developing roller 44. On the other hand, the pattern P2 equivalent to the evaluative image segment may have another pattern. However, it is preferred that the pattern P2 is also defined by a solid image, which facilitates the identification of the image defects such as streaking, fading, thin spots or the like and which can be compared with the pattern P1. As a matter of course, these patterns must be formed using the same developing roller. That is, the two patterns must be formed in the same toner color.

Figure 7:
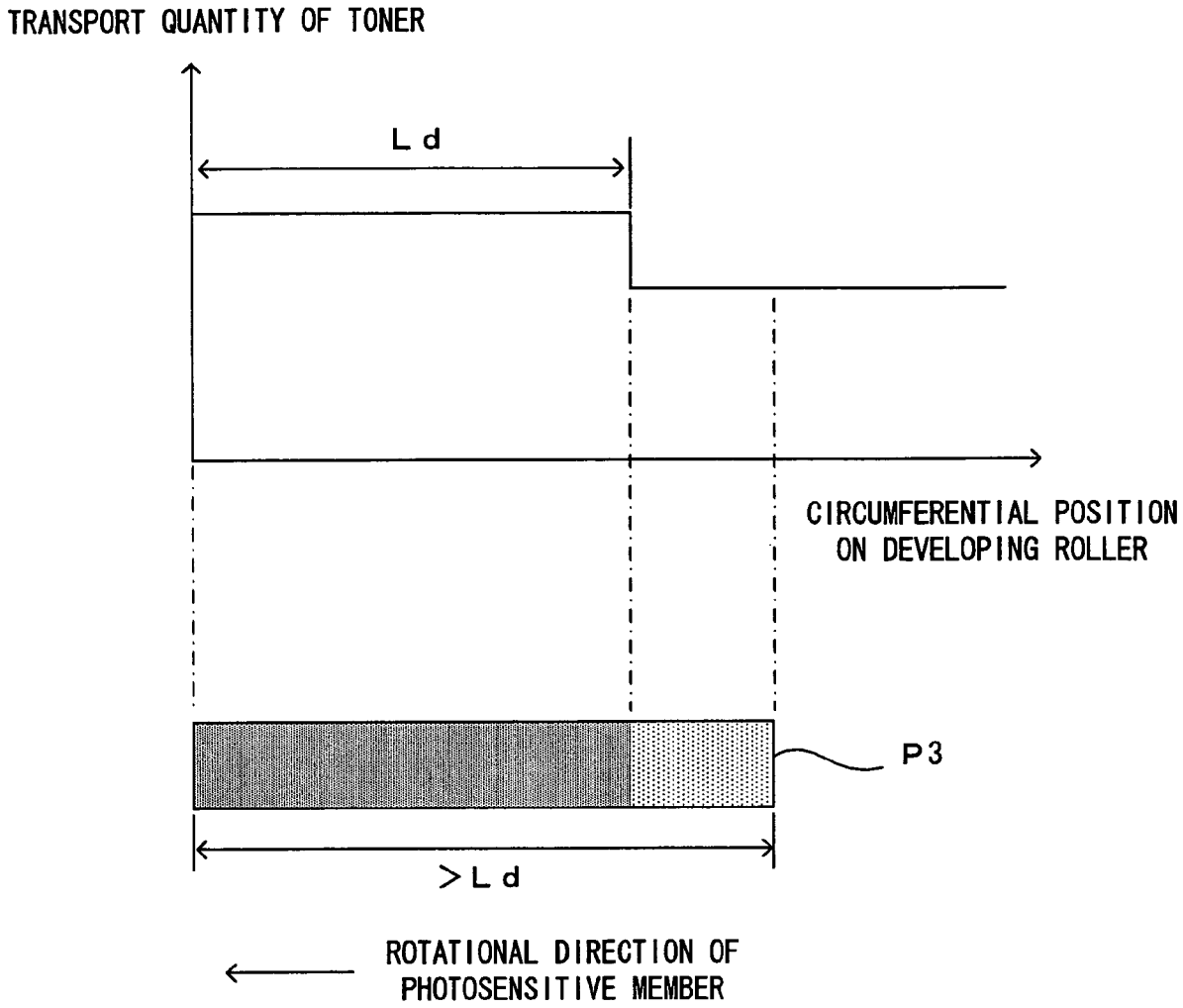
FIG. 7 is a diagram showing another exemplary test pattern.

FIG. 7 is a diagram showing another exemplary test pattern. A test pattern P3 of this example has a greater length along a rotational direction of the photosensitive member 22 than the length Ld corresponding the circumferential length of the developing roller 44, and includes a uniform image pattern in the image area thereof. A process of forming such a test pattern P3 is considered. When the formation of the test pattern P3 is started at the development position DP (FIG. 5), the consumption of the toner on the developing roller 44 is started. At the point of time that the developing roller 44 has just made one revolution while the length of the image visualized on the photosensitive member 22 has reached the length Ld, the developing roller 44 starts making the second revolution whereas the image formation is continued. In this example, it may be considered that the two patterns P1 and P2 of FIG. 6 are continuously formed as a single image. The toner on the developing roller was consumed for forming the test pattern P3 during the preceding revolution of the developing roller. Therefore, if the residual quantity of toner in the developer is low, a quantity of toner transported on the developing roller 44 in the second revolution is decreased from that transported in the first revolution. In the test pattern P3, therefore, the poor image density due to toner shortage occurs in an area more than the above length Ld away from a head (the left-hand end as seen in FIG. 7) with respect to the rotational direction of the photosensitive member. In consequence, the test pattern P3 has different image densities at opposite areas with respect to a boundary located at the distance Ld from the head thereof.

Such discontinuity of the image density in the uniform image pattern is easier to visually recognize than the density difference between the two image patterns P1 and P2 spacedly arranged as shown in FIG. 6. If a recognizable degree of density difference occurs between the opposite areas with respect to the boundary, it is expected that images to be formed by a normal image forming operation will suffer obvious density variations. If, on the other hand, the density difference is not visually recognized, it is expected that a noticeable degree of density variation will not occur. As an image-quality evaluation image, there may be formed the image which includes the image segments formed using the toner carried on the respective surface regions of the developing roller 44, one region having the toner thereon consumed in the preceding revolution of the roller, the other region holding the toner unconsumed in the preceding revolution, and in which these image segments are arranged in mutually adjoining relation. Such an image provides for easy evaluation of the degree of the image quality degradation due to the shortage of toner.

A width of the pattern with respect to a direction perpendicular to the rotational direction of the photosensitive member may be defined arbitrarily. However, the evaluation of image quality becomes difficult unless the test pattern has a certain area. According to the experiments made by the present inventors, the width needs to be at least 2 mm. Conversely, if the width is too wide, the toner consumption is increased. Hence, an appropriate width is considered to be a few millimeters. The same applies to the widths and lengths of the patterns P1, P2 shown in FIG. 6.

Figure 8:
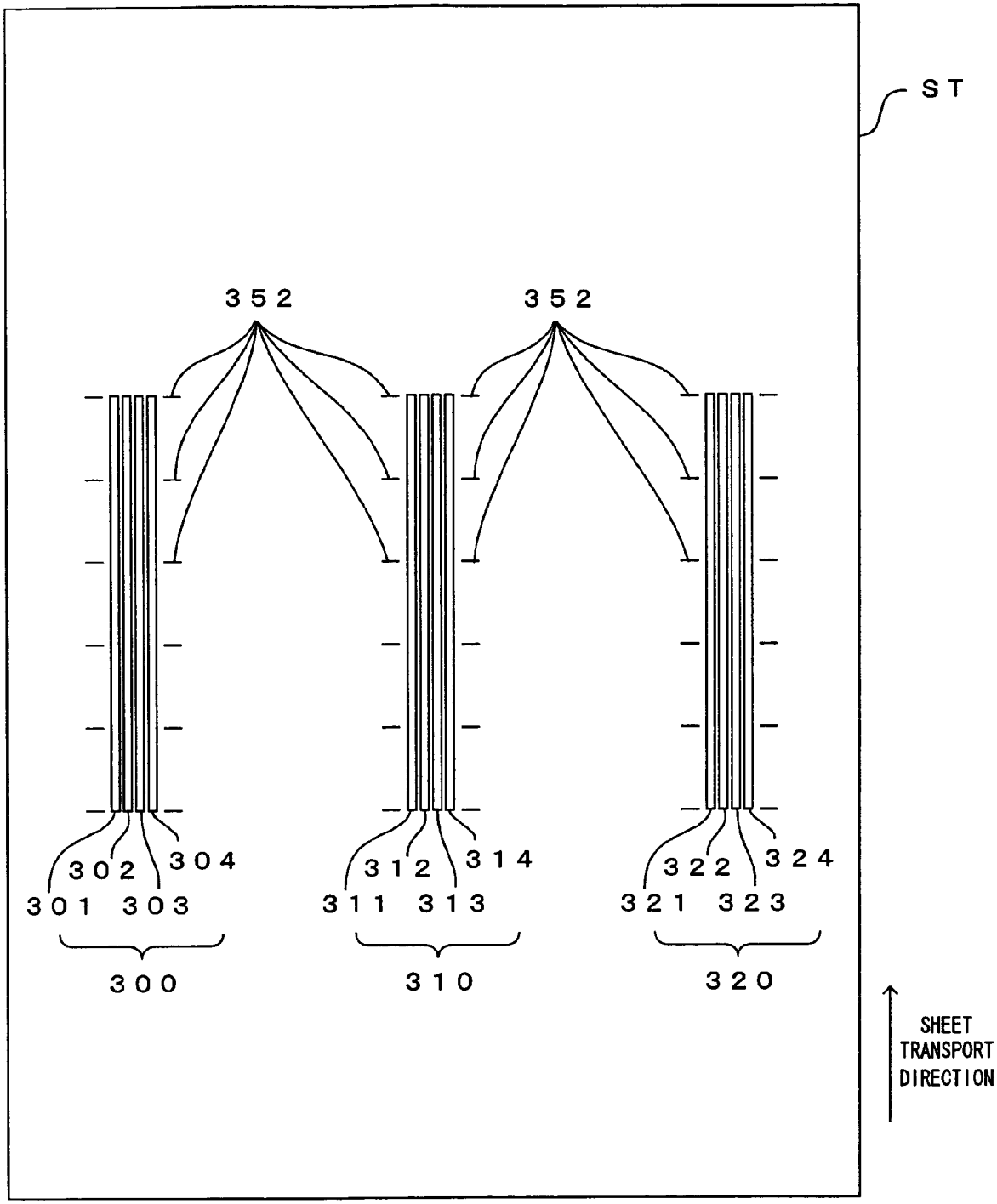
FIG. 8 is a diagram showing an exemplary status sheet according to the embodiment.

FIG. 8 is a diagram showing an exemplary status sheet according to the embodiment. A test pattern consisting of four band-like patterns of the four toner colors of K, M, C, Y is formed at each of three places, at the center, a left end and a right end of the status sheet ST. More specifically, formed at the left end of the sheet is a left-end test pattern 300 wherein a black band-like pattern 301, a agenta band-like pattern 302, a cyan band-like pattern 303 and a yellow band-like pattern 304 are arranged with predetermined spacing as extended in parallel with one another. Likewise, a central test pattern 310 with black, magenta, cyan and yellow band-like patterns 311-314 arranged in parallel relation is formed centrally of the sheet, whereas a right-end test pattern 320 including band-like patterns 321-324 arranged in the same color order is formed at place.

The reason for arranging such image contents of the status sheet ST is given as below. First, it is for the sake of easy identification of image defects such as streaking, fading, thin spots or the like that the band-like pattern is formed along the sheet transport direction on a per-toner-color basis, the image defects becoming more apparent as the developing roller 44 continues revolving. Even in a state where the toner in the developer is decreased in quantity or deteriorated in the properties thereof, a header portion of an image formed in an early stage of image formation has a relatively high density. This is because the developing roller 44 rotates prior to the start of the image forming process, thereby gathering up the toner on the surface thereof. Once the image forming process is started, however, the quantity of toner refurnished to the developing roller 44 falls short of the quantity of toner used for the image formation, so that the resultant images are progressively decreased in density. The image pattern is formed in the band-like shape extending along the moving direction of the surface of the developing roller 44, thereby offering the easy identification of the image defects which become progressively more apparent. If the band-like pattern has a greater length than a circumferential length of the developing roller 44, in particular, the identification of the image defects may be further facilitated. Since this embodiment defines the length of the band-like pattern to be a circumferential length of the photosensitive member 22 having a greater diameter than the developing roller 44, this requirement is satisfied.

On the other hand, scale-mark patterns 352 provided laterally of the band-like patterns serve to help the user intuitively figure out the degree of image degradation. That is, the user is permitted not only to determine whether each of the band-like patterns sustains the image defects or not, but also to figure out the degree of image degradation by checking at what scale-mark the image defects appear. The occurrence of the image defects on the band-like pattern does not necessarily mean that the subsequent images to be formed are suddenly lowered in quality. The reason is that the band-like pattern 301 and the like are continuous solid images formed along the moving direction of the surface of the developing roller 44 and having an image pattern which takes away the greatest quantity of toner from the surface of the developing roller 44 (that is, the image pattern is most prone to the image defects). A normal image forming process seldom involves such extreme toner consumption and hence, such noticeable image defects do not always occur.

However, it is also a fact that the image defects appearing at the upper position of FIG. 8 indicate the earlier occurrence of image degradation. With this in view, individual scale-mark positions are correlated with respective estimated numbers of formable images (say, 100 images per scale-mark). Such a correlation may be printed in the vicinity of the scale-mark patterns or indicated in an instruction manual of the apparatus, thereby enabling the user to figure out an approximate number of images to be formed subsequently. Thus, the user convenience is further enhanced. There may also be provided an indication that in a case where the band-like pattern sustains streaking, fading, thin spots or the like at the uppermost part thereof, the developer in question is already unadapted for the image formation.

The length of each band-like pattern is substantially equal to the circumferential length of the photosensitive member 22. This is directed to the easy identification of the density variations or image defects which are caused by the eccentricity or flexure of the photosensitive member 22 to appear in periods of the circumferential length thereof. If the band-like pattern is shorter than this length, such periodical density variations may be overlooked.

On the other hand, there may be a case where such periodical density variations or image defects appear in periods of the circumferential length of the developing roller 44. Hence, the embodiment defines the spacing of the scale-mark patterns 352 to be equal to the circumferential length of the developing roller 44, thereby providing the easy identification of such periodical density variations caused in association with the revolution of the developing roller 44. There may also be a case where similar density variations appear in correspondence to a circumferential length of the supply roller 43 disposed in the developer for supplying the toner to the surface of the developing roller 44. It is therefore desirable to decide the length of the band-like pattern or the spacing of the scale-mark patterns according to a manner that such density variations appear.

In this embodiment, the spacing of the scale-mark patterns is set to the circumferential length of the developing roller 44 because the developing roller 44 and the photosensitive member 22 move at the same surface moving speed with respect to position where these members are opposed to each other. However, in an image forming apparatus of a non-contact development system, in particular, the moving speeds of these members may not be the same in cases. In this case, it is preferred to change the spacing of the scale-marks (or the length of the band-like pattern) properly according to the length equivalent to the circumferential length of the developing roller 44. Specifically, with respect to the opposed position to the developing roller, a distance moved by the photosensitive member surface 22 during one revolution of the developing roller 44 is equivalent to "the length equivalent to the circumferential length of the developing roller 44" in this case.

On the other hand, the test patterns 310, 300, 302 each consisting of the four band-like patterns are formed at the three places, at the center and the transversal ends of the sheet, respectively. This pattern layout is directed to the easy identification of the density variations which are caused by the eccentricity or flexure of the photosensitive member 22 or the developing roller 44 to appear along a direction parallel to a rotary axis thereof.

Each of the band-like patterns may preferably be a monochromatic image such that the presence of the image defects per toner color may be evaluated correctly. On the other hand, the scale-mark patterns 352 formed in the vicinity of the band-like patterns may be either one of a monochromatic image of a color selected based on predetermined reference value and a color-mixture image formed by superimposing toner images of two or more colors. The scale-mark patterns need be displayed in a user readable state. If these patterns are too thin, the patterns fail to contribute to the enhancement of user convenience. In the case of the scale-mark pattern defined by the monochromatic image, therefore, the color of a toner to be used may be decided as follows, for example. In a first approach, one of the developers, that has the greatest residual toner quantity, may be used so that the possibility of producing the streaking, fading, thin spots or the like may be minimized. In a case where plural developers have sufficient residual toner quantities, one of the toner colors, that offers the highest legibility, may be adopted. In either case, a yellow monochromatic image has such a high light reflectivity and is less visible to the common users. In a case where the sheet S used as the status sheet is white, for example, it is desirable to avoid forming the yellow monochromatic image as the scale-mark pattern.

In the case of the scale-mark pattern 352 defined by the color-mixture image including two or more colors, there is no problem in reading the scale-mark if one of the colors presents a sufficient density. In the case of a color-mixture image including all the four colors, in particular, such heavy fading as to disable the reading of the scale-mark scarcely occur unless all the developers run out of the toners. Incidentally, it is also possible to form the respective scale-mark patterns in individually different toner colors.

According to the embodiment as described above, the status sheet assisting the user in figuring out the conditions of the respective developers is obtained as required. The status sheet contains the band-like patterns of the respective toner colors, which extend along the moving direction of the developing roller 44, and the scale-mark patterns formed in the vicinity of the band-like patterns and arranged in correspondence to the circumferential length of the developing roller 44. Therefore, the user can correctly check the qualities of the discrete images formed by the respective developers.

Furthermore, the length of the band-like pattern is defined to be substantially equal to the circumferential length of the photosensitive member 22, whereas the spacing of the scale-mark patterns is defined to be equal to the circumferential length of the developing roller 44. Therefore, even the image defects periodically occurring in association with the revolutions of these members may be identified easily.

In addition, a plural number of band-like patterns of one toner color are formed at different places. Therefore, if the image density varies from place to place, such image defects may be identified easily.

If the scale-mark pattern is defined by a monochromatic image of a color of a toner having the greatest residual quantity, or a color-mixture image including plural toner colors, the problem that scale-mark pattern is too thin to read may be obviated.

Figure 9A:
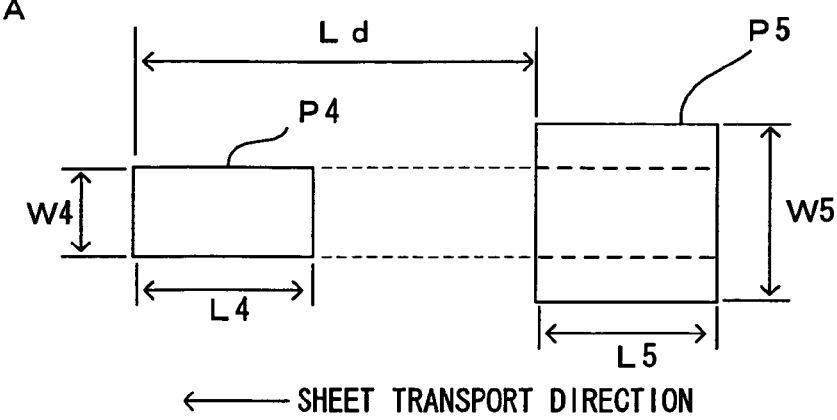
FIGS. 9A to 9C are diagrams each showing another exemplary test pattern.
Figure 9B:
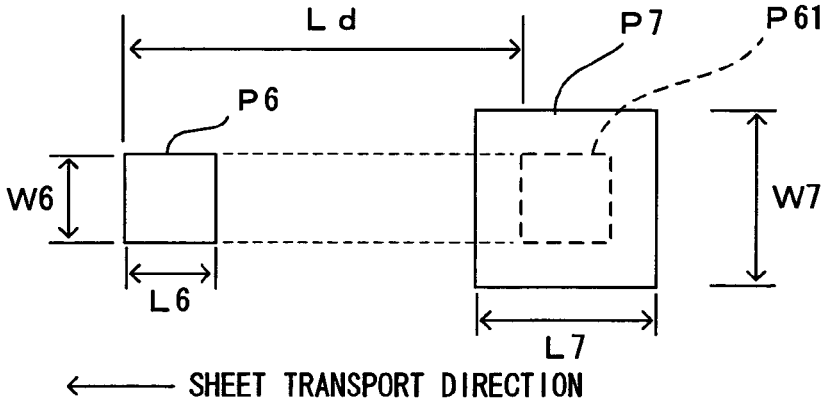
Figure 9C:
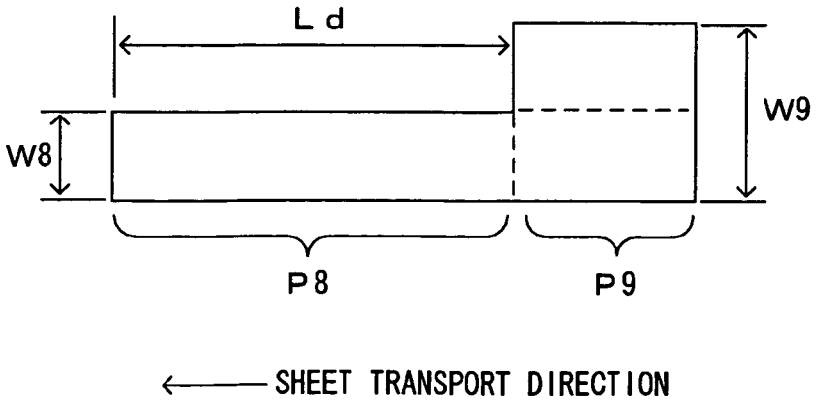

FIGS. 9A to 9C are diagrams each showing another exemplary test pattern. FIG. 9A to FIG. 9C each show the test pattern transferred to the sheet S, as the status sheet, after going through the photosensitive member 22 and the intermediate transfer belt 71. The test pattern illustrated in FIG.

9A includes an image pattern P4 having a length L4 along a sheet transport direction in the transport path F and a width W4 along a direction perpendicular thereto (hereinafter, referred to as "widthwise direction"), and an image pattern P5 having a length L5 and a width W5 (provided, L5≦L4, W5>W4). A distance between the respective heads of these image patterns (the respective left-hand ends of the patterns as seen in the figure) is the length Ld corresponding the circumferential length of the developing roller 44. In this test pattern, an area defined between broken lines in the pattern P5 is equivalent to the evaluative image segment. On the other hand, an area outward of the broken line in the pattern P5 constitutes the reference image segment of the invention. The reason is as follows. Although this image area is formed during the second revolution of the developing roller 44 just as the evaluative image segment, the toner on a surface region of the developing roller 44 that corresponds to this image area is not consumed during the immediately receding revolution of the roller.

The example of FIG. 9B illustrates a test pattern wherein a pattern P6 and a pattern P7 are formed as follows. The pattern P6 having a length L6 and a width W6 is formed in a first revolution of the developing roller 44. In the subsequent revolution of the developing roller, the pattern P7 having a length L7 and a width W7 (provided L7>L6, W7>W6) is formed using the toner on a surface region surrounding a surface region having the toner thereon consumed for forming the pattern P6. In the pattern P7, an evaluative image segment P61 corresponding to the pattern P6 has its overall periphery enclosed by the reference image segment. Although relatively small in size, the image pattern can define a longer boundary line between the evaluative image segment and the reference image segment. Accordingly, this image pattern can accomplish the decrease of toner consumption without impairing the ease of image quality evaluation.

In these examples, the image patterns P4, P6 formed in the preceding revolution have rectangular shapes, but may have other shapes. Furthermore, the image patterns may also represent symbols or characters. In this method, the image quality may be judged based on whether the symbol or character is legible or not against the image pattern P5 or P7 formed in the subsequent revolution of the developing roller. Specifically, if the symbol or character appears in the image pattern P5 of P7 as an outline character on a white background (where the sheet S is white), it is apparent that the residual toner is short. On the other hand, if the symbol or the like is barely readable, the toner end is drawing near. If the symbol or the like is totally unreadable, there is no fear of the degraded image quality.

A test pattern illustrated in FIG. 9C consists of an image segment P8 having the length Ld and a width W8, and an image segment P9 having a width W9 and formed as adjoining a tail end of the image segment P8. In this test pattern, an evaluative image segment (the lower half of the image segment P9) adjoins reference image segments (the image segment P8 and the upper half of the image segment P9) on two sides thereof. The image quality may be judged based on whether the discontinuity of image density exists on the boundaries of the evaluative image segment or not.

These test patterns may preferably be used for evaluating the degree of the image quality degradation due to the shortage of residual toner. According to the embodiment, if the user demands it when the near-end message is displayed with respect to any of the toner colors, the status sheet including the test patterns of the respective toner colors is outputted such as to enable the user to check the image quality. In this case, the test pattern may be formed only in the toner color related to the near-end message, or the test patterns may be formed in all the toner colors. It is assumed here that when the near-end message is displayed with respect to one of the toner colors, the test patterns are formed in all the toner colors.

Figure 10:
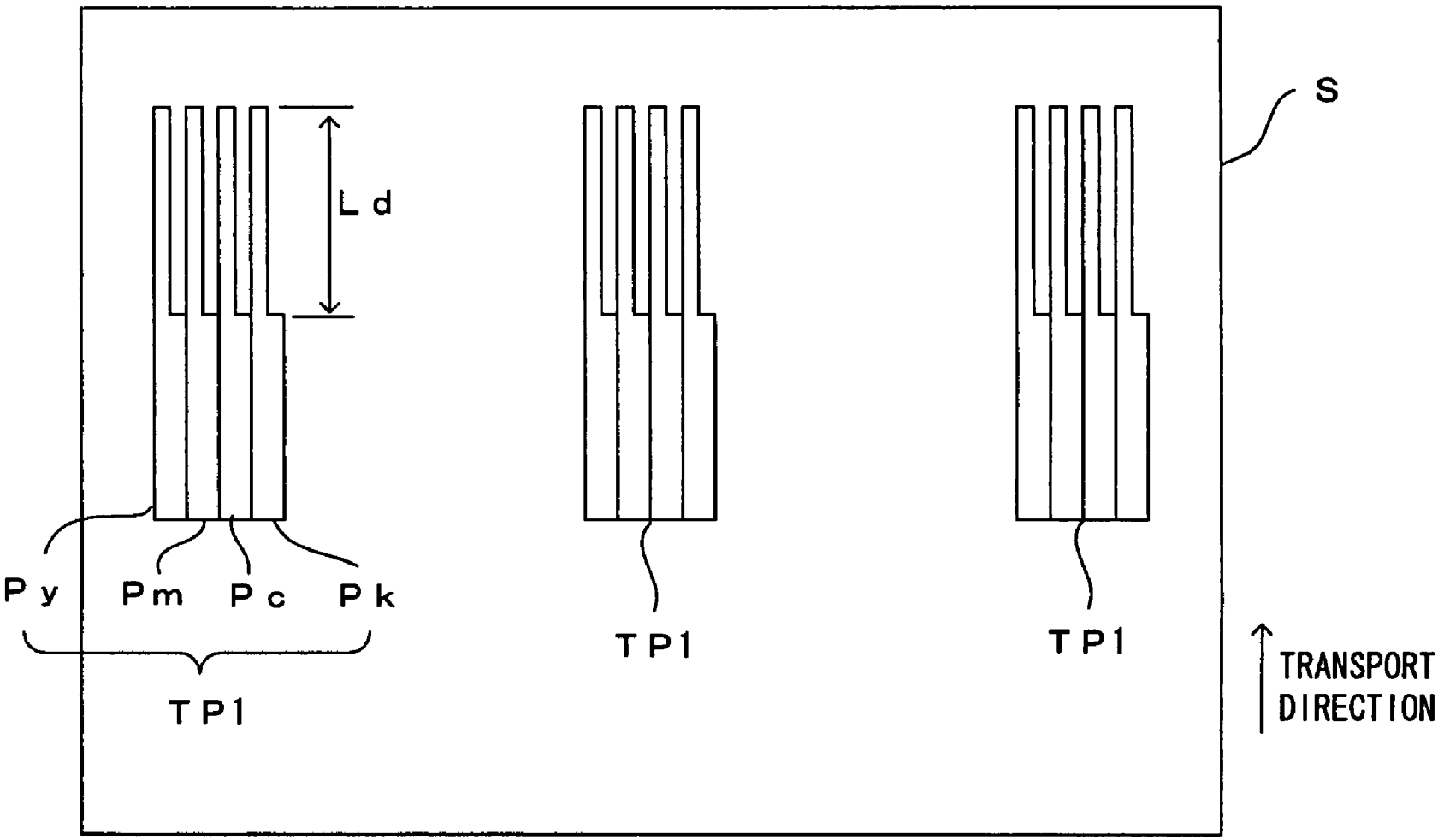
FIG. 10 is a diagram showing exemplary image patterns on the status sheet.

FIG. 10 is a diagram showing exemplary image patterns on the status sheet. In this example, a test pattern TP1 consisting of images Py, Pm, Pc and Pk of magenta, yellow, cyan and black is formed on the sheet S at three different places shifted along the widthwise direction of the sheet transported in a horizontally longitudinal direction. The individual images have a shape equivalent to that illustrated in FIG. 9C. The reason for forming three sets of test patterns is as follows.

The image forming apparatus of this type tends to encounter density variations with respect to a direction of the width of the sheet S due to the eccentricity or flexure of the photosensitive material 22 or the developing roller 44. In this connection, the test pattern TP1 formed at only one place leads to a fear that the degraded image quality, such as density variations, possibly occurring at another place may be overlooked. However, if the test pattern itself is extended along the width, the toner consumption is increased, which is uneconomical. Such a problem may be solved by forming plural sets of test patterns at mutually different places with respect to the widthwise direction. In this embodiment, the test pattern TP1 is formed at three places in total, the central place and the opposite places with respect to the widthwise direction of the sheet S. If the image quality varies from place to place due to the eccentricity or flexure of the photosensitive member 22 or the developing roller 44, this method ensures that the image quality is correctly evaluated without overlooking the defect.

Figure 11:
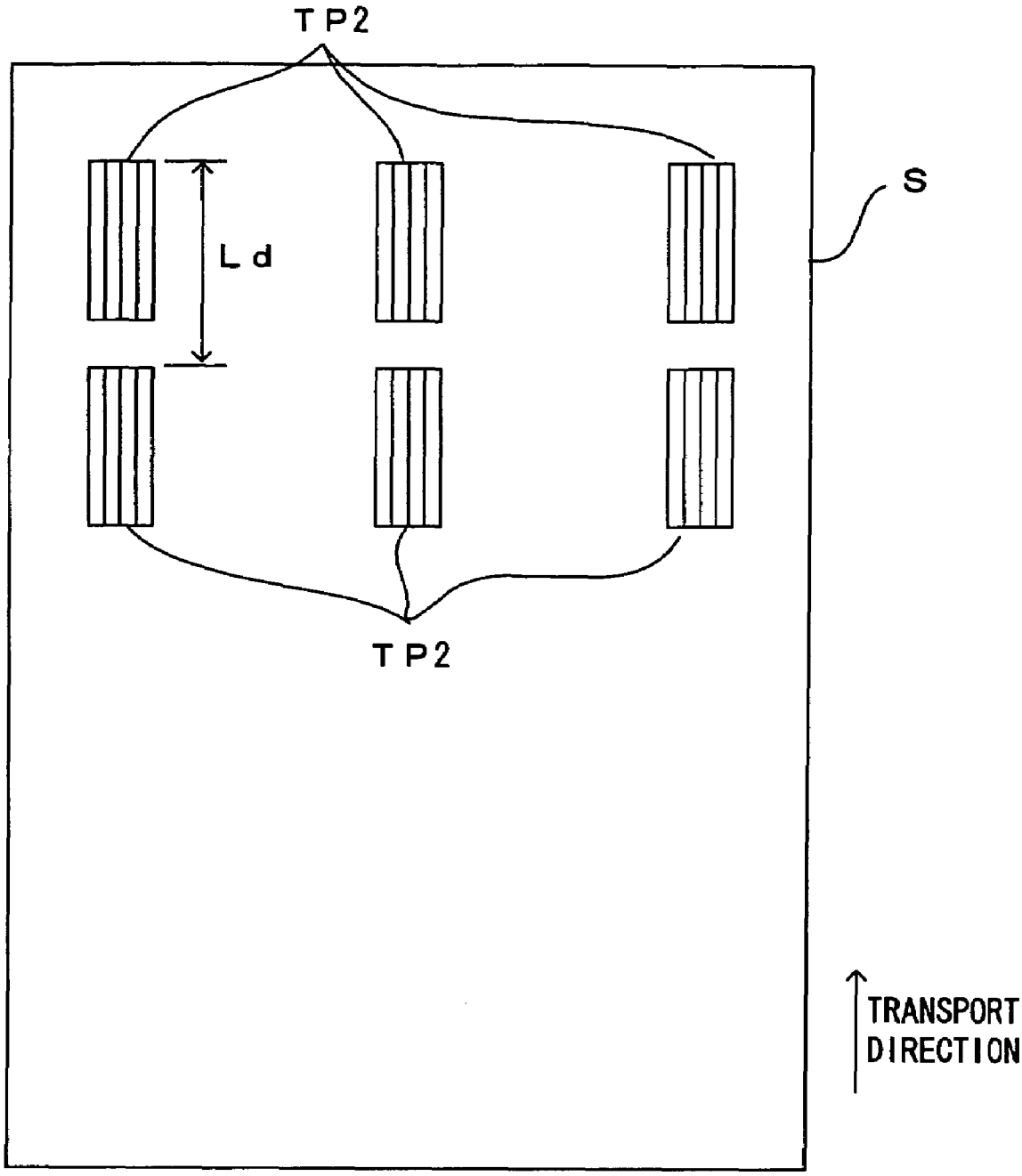
FIG. 11 is a diagram showing another exemplary image pattern.

FIG. 11 is a diagram showing another exemplary image pattern on the status sheet. In this example, the sheet S is transported in a vertically longitudinal direction, whereas the formed image pattern is equivalent to that shown in FIG. 6. Specifically, six sets of test patterns TP2 are formed on the sheet in this example, each test pattern consisting of band-like images of the four toner colors.

According to the embodiment as described above, the image-quality evaluation image is formed on the status sheet for the evaluation of image quality, the image-quality evaluation image including the image segment formed using the toner carried on the surface region of the developing roller 44, the region having the toner thereon consumed for image formation in the preceding revolution of the developing roller. Such an image segment is prone to the degraded image quality associated with the shortage of residual toner. Hence, the user may readily judge the image quality by observing the status sheet thus obtained. Furthermore, in combination with the above image segment, the other image segment is formed using the toner carried on the other surface region of the developing roller 44, the region holding the toner unconsumed during the preceding revolution of the developing roller. Thus, the densities of these image segments may be compared to evaluate the image quality. Particularly if these image segments are arranged in adjoining relation, the density differences appear as an obvious discontinuity of image density on the boundary between these image segments. This makes the evaluation much easier.

In this embodiment as described above, each of the developers 4Y, 4M, 4C, 4K functions as "toner storage unit" of the invention. Furthermore, the developing roller 44 and the engine EG provided at each developer function as "toner carrier" and "image forming unit" of the invention, respectively.

While each of the image segments constituting the test pattern is defined by a solid image in the above first embodiment, the image pattern of each image segment is not limited to this. The image segment may have another pattern, such as a half-toned image pattern. It is noted however that both the image segments may preferably have the same pattern in order to provide a more discernable density difference between these image segments. In addition, the image segments may also have any other shape than the above.

In the above first embodiment, the status sheet containing the test pattern including the images of all the four toner colors is outputted after the near-end message is displayed with respect to at least one of the four toner colors. However, the output of the status sheet is not limited to this. For instance, the status sheet may be outputted irrespective of the residual toner quantity but in response to a demand from the user or the external apparatus. Otherwise, the status sheet may be outputted irrespective of the external demand but in response to the displayed near-end message related to any of the toner colors. On the other hand, the status sheet S does not always need be formed with the test pattern of all the toner colors. For instance, the test pattern may be formed only in a toner color that is related to the displayed near-end message. In addition, the image patterns of the individual colors may be arranged arbitrarily.

Second Embodiment

While the test pattern is formed on only one side of the sheet S (recording medium) in the above first embodiment, the test pattern may also be formed on the both sides of the sheet S as will be described as below. Referring to FIG. 12 to FIG. 15, FIG. 16A and FIG. 16B, a second embodiment will be described as below. In the second and succeeding embodiments, the apparatus is basically arranged the same way as in the first embodiment. Therefore, like components will be represented by like reference characters, respectively, the description of which is dispensed with.

Figure 12:
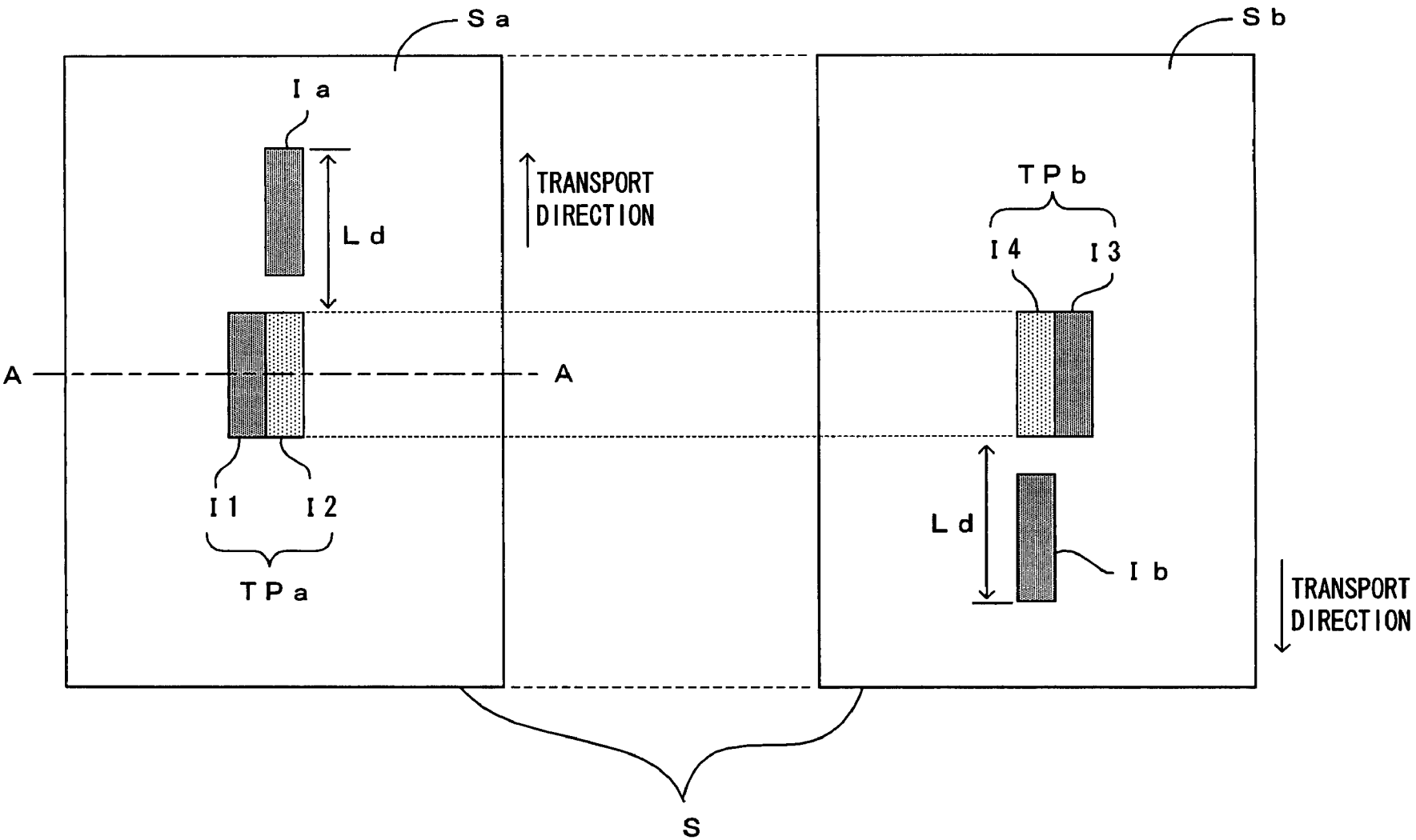
FIG. 12 is a diagram showing the arrangement of the test pattern on the status sheet in a second embodiment.

FIG. 12 is a diagram showing the arrangement of the test pattern on the status sheet. In this embodiment, a test pattern TPa consisting of image segments I1 and I2 is formed on one side Sa of the sheet S as the status sheet. These two image segments I1 and I2 comprise the same image pattern such as a solid image pattern. That is, the test pattern TPa has an area combining those of the two image segments I1 and I2 and is to define, in principle, a solid image having a consistent image density. Prior to the formation of the test pattern TPa, a header image segment Ia is formed. The header image segment Ia has a size substantially equal to or slightly larger than that of the image segment I2. The header image segment is formed at place shifted forwardly from the image segment I2 by the length Ld with respect to the sheet transport direction. Hence, the image segments I2 and Ia have a similar relation to that of the aforementioned image patterns P1 and P2 (see FIGS. 5 and 6), so that these image segments are visualized with the toner carried on substantially the same surface region of the developing roller 44.

Thus, the image segment I2 of the test pattern TPa is formed using the toner carried on a surface region of the revolving developing roller 44, the region having the toner thereon consumed for forming the header image segment Ia in the immediately preceding revolution of the developing roller and refurnished with the toner in the developer. As described in the foregoing, therefore, the poor image density or density variations are likely to occur unless a sufficient quantity of toner remains in the developer. In contrast, the header image segment Ia and the image segment I1 are each free from another preceding image. That is, these image segments are formed using the toner carried on surface regions of the developing roller, the regions holding the toner unconsumed in the immediately preceding revolution of the developing roller. Accordingly, these image segments I1 and Ia are less likely to suffer the poor image density or the density variations as compared with the image segment I2. Therefore, when the residual toner quantity is low, there arises a density difference between the two image segments I1 and I2 constituting the test pattern TPa. Particularly if the image segments I1 and I2 are arranged in mutually adjoining relation, the discontinuity of image density is clearly observed on a boundary between these image segments. If the residual quantity of toner is sufficient, on the other hand, such a density difference is barely noticeable. That is, whether the degradation of image quality due to the shortage of residual toner starts to proceed or not can be determined by discerning the density difference between these image segments.

At an initial stage of such a degradation of image quality, however, the density difference between the image segments I1 and I2 is so little that it is never easy for the general users to discern the difference. In order to solve this problem and to provide an easy evaluation of the image quality, the embodiment is adapted to form a similar image pattern on the opposite side of the status sheet as well. That is, a test pattern TPb is also formed on a side Sb of the sheet S as the status sheet, which is opposite from the side Sa formed with the test pattern TPa. For convenience in explanation, the one side Sa of the sheet S will hereinafter be referred to as "front side", whereas the other side Sb will be referred to as "back side". However, these nominal designations are irrespective of the order of pages of actually used status sheets or the order of forming images.

Figure 13:
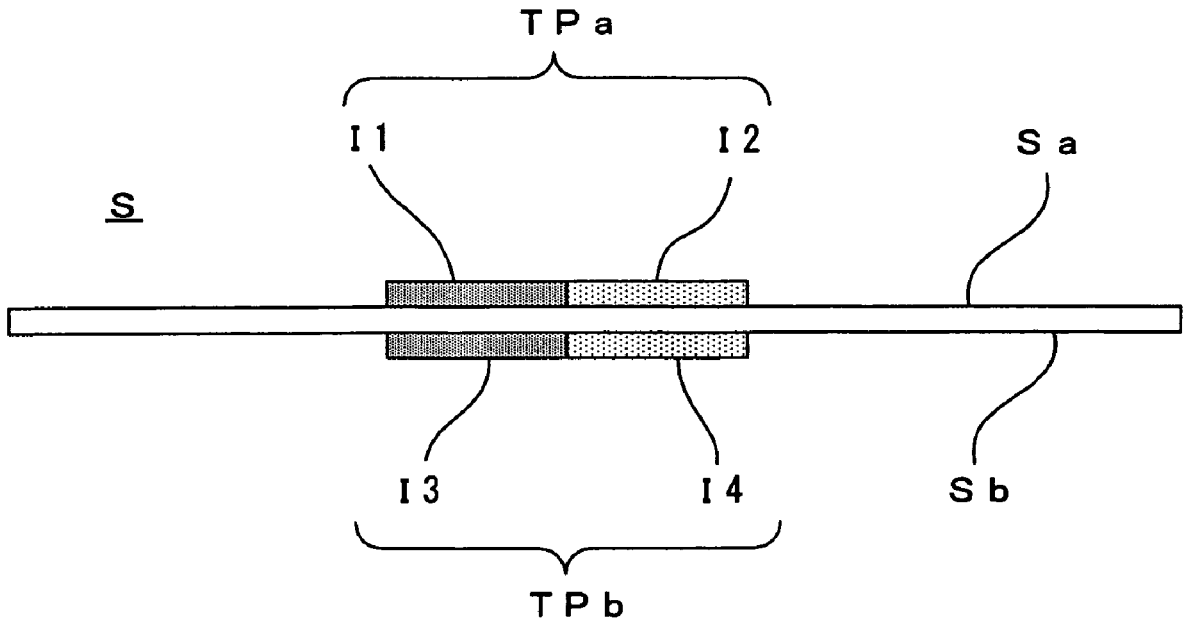
FIG. 13 is a schematic sectional view of the status sheet in the second embodiment.

FIG. 13 is a schematic sectional view of the status sheet. More specifically, the figure shows a section of the sheet S taken on the dot-dash line A-A in FIG. 12. As shown in FIGS. 12 and 13, the test pattern TPb consists of two solid image segments 13 and 14 having the same size as that of the image segments I1 and I2 formed on the front side Sa. The image segment I3 is formed on the back side Sb at place corresponding to the place where the image segment I1 on the front side Sa is formed. That is the image segment I1 and the image segment I3 are so positioned as to exactly overlap on each other as seen through the sheet S. Likewise, the image segment I4 is formed on the back side Sb at place corresponding to the place where the image segment I2 on the front side Sa is formed.

Furthermore, a header image segment Ib is provided forwardly of the image segment I4 with respect to the sheet transport direction. It is noted that the image forming apparatus of the embodiment has the sheet transport paths F, FR shown in FIG. 1 and hence, the leading end of the sheet S as first formed with the image will become the trailing end thereof at the subsequent image formation. Accordingly, the "forward direction" on the front side Sa with respect to the sheet transport direction is in the opposite direction on the back side Sb. As shown in FIG. 12, therefore, the image segments Ia and Ib on the respective sides are not overlapped on each other.

The header image segment Ib is also formed at place shifted forwardly of the image segment I4 by the length Ld. As a result, the image segment I4 is formed using the toner carried on a surface region of the revolving developing roller 44, the region having the toner thereon consumed for forming the header image segment Ib in the immediately preceding revolution of the developing roller and then refurnished with the toner in the developer. On the other hand, the image segment I3 is formed using the toner carried on a surface region of the developing roller 44, the region holding the toner unconsumed in the immediately preceding revolution of the developing roller. In a case where the residual toner quantity is low, therefore, the test pattern TPb also sustains the density difference between these image segments I3, I4.

Since the paper commonly used as the sheet S does not have a perfect light shielding effect, the image formed on one side thereof can also be seen through from the opposite side thereof. In the status sheet with the test patterns TPa and TPb formed on the opposite sides thereof, as described above, the two image segments of the higher densities and the two image segments of the lower image densities, of the respective test patterns on the opposite sides of the sheet, are overlapped on each other. Therefore, the respective pair of image segments constituting the individual test patterns are viewed with an enhanced density difference therebetween. This facilitates the judgment of image quality at the initial stage of image quality degradation caused by the shortage of residual toner.

When the density difference between the image segments is not observed, it may be determined that the degree of the image quality degradation is insignificant. If the residual quantity of toner is apparently short, the individual test patterns suffer noticeable poor density or fading, or the two image segment pairs constituting the respective test patterns present an obvious density difference. Hence, the status sheet containing the test patterns according to the embodiment may be obtained so that the image quality may be readily evaluated in such cases.

Figure 14:
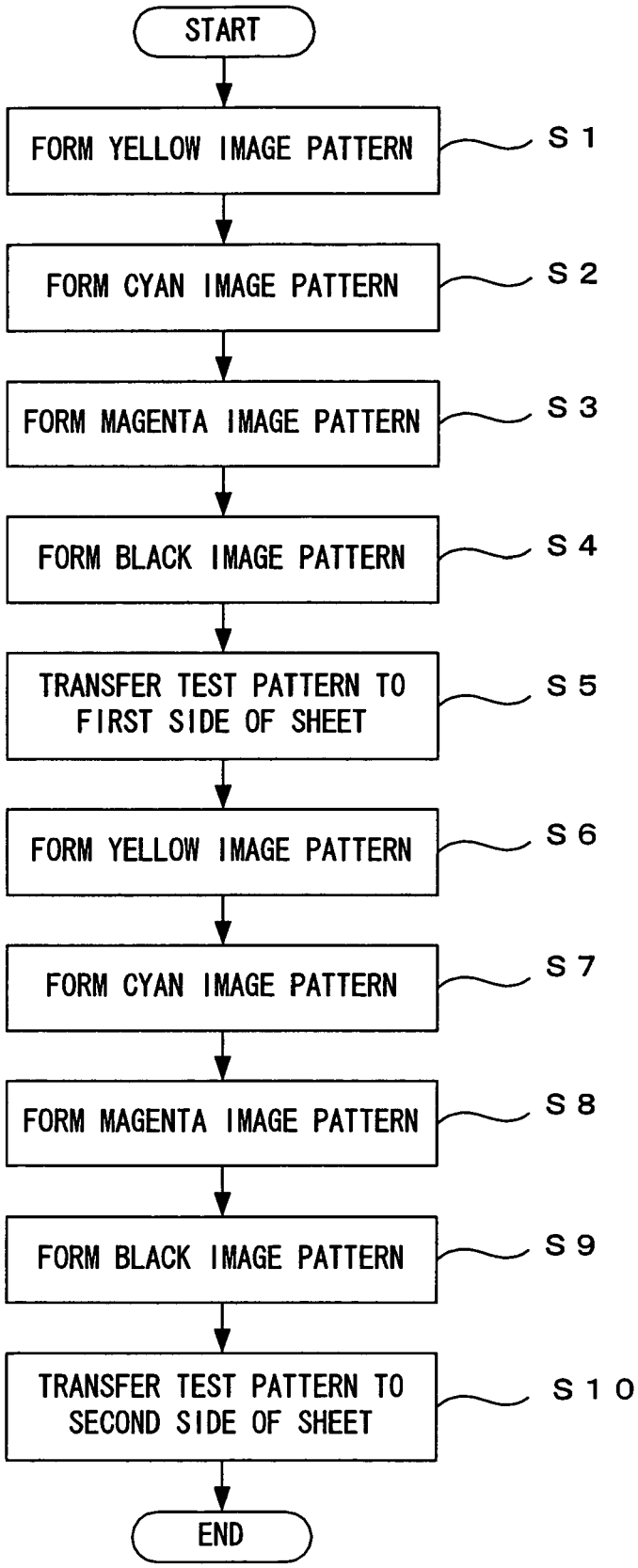
FIG. 14 is a flow chart showing the steps of a procedure for obtaining the status sheet.
Figure 15:
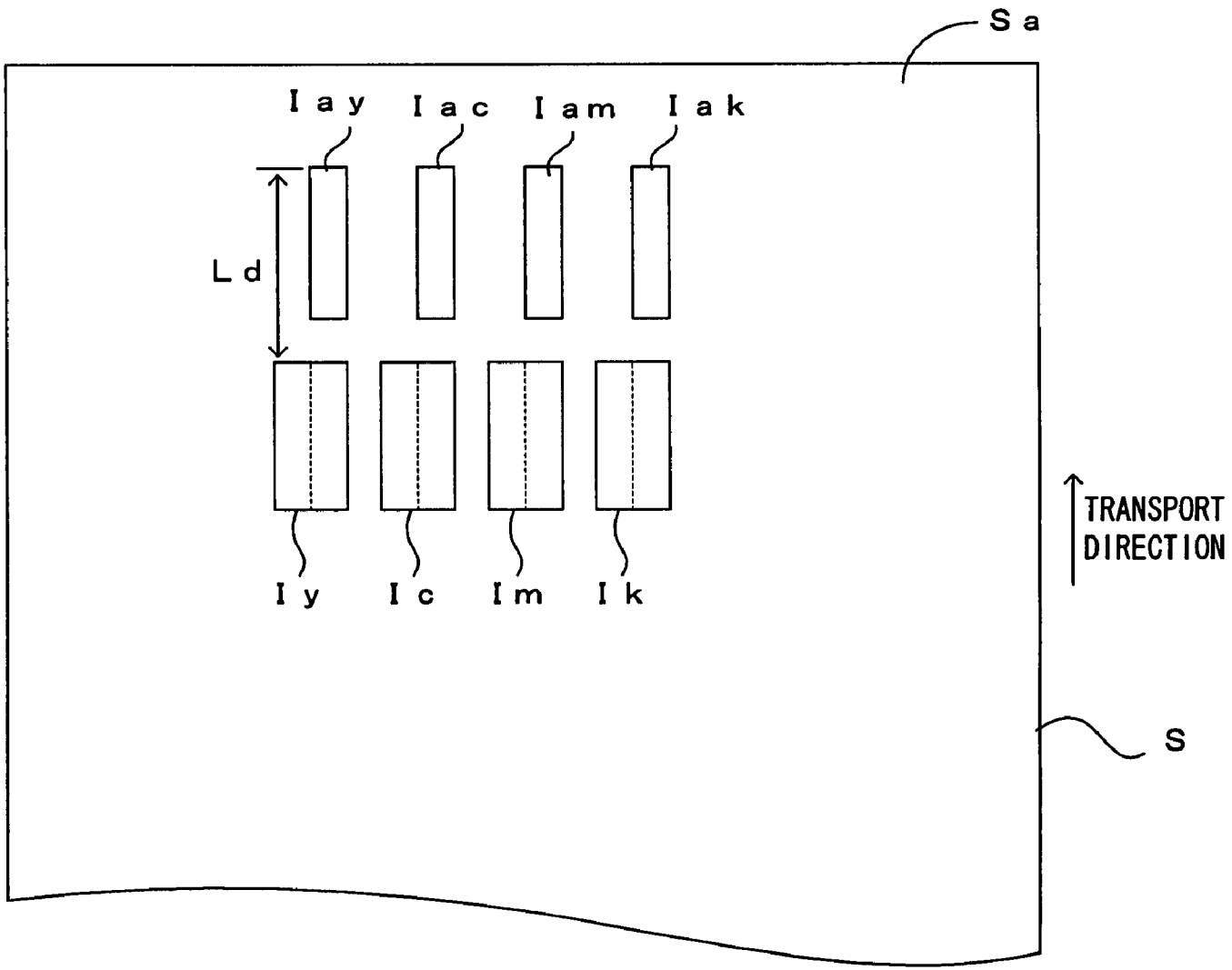
FIG. 15 is a diagram showing an example of image patterns.

FIG. 14 is a flow chart showing the steps of a procedure for obtaining the status sheet. FIG. 15 is a diagram showing an example of image patterns on the status sheet. In this embodiment, processes shown in FIG. 14 are performed to prepare the status sheet including the image patterns shown in FIG. 15 in a case where the user demands the status sheet after the display of the near-end message related to at least one of the toner colors. According to the procedure for obtaining the status sheet, individual test patterns of the four toner colors are first formed on the front side Sa of the sheet S. Specifically, the yellow developer 4Y, the cyan developer 4C, the magenta developer 4M and the black developer 4K are sequentially positioned at place opposite the photosensitive member 22 in the order named, while an image pattern similar to that shown in the left-hand part of FIG. 12 is formed in each of the toner colors at each different place (Steps S1 to S4). Subsequently, these image patterns are transferred to the front side Sa of the sheet S and fixed thereto (Step S5). Thus, header image segments Iay, Iac, Iam and Iak of the yellow, cyan, magenta and black toner colors, and test patterns Iy, Ic, Im and Ik of the respective toner colors are formed on the front side Sa of the sheet S, as shown in FIG. 15.

Subsequently, image patterns similar to that shown in the right-hand part of FIG. 12 are formed in the respective toner colors on the back side Sb of the sheet S (Steps S6 to S10). In the status sheet thus obtained, the respective test patterns of the same toner color, formed on the respective sides of the sheet S, are overlapped on each other. In addition, the test pattern of each color has an arrangement wherein the evaluative image segment and the reference image segment adjoin each other. The evaluative image segment is formed using the toner carried on the surface region of the developing roller 44, the region having the toner thereon consumed for image formation in the preceding revolution of the developing roller. The reference image segment is formed using the toner carried on the surface region of the developing roller 44, the region holding the toner unconsumed for image formation in the preceding revolution of the developing roller. Furthermore on the opposite sides of the sheet S, overlapped on each other are the image segments formed using the toner carried on the developing-roller surface regions having the toner consumed for image formation in the preceding revolution of the developing roller 44, whereas the image segments formed using the toner carried on the developing-roller surface regions holding the toner unconsumed for image formation in the preceding revolution are overlapped on each other.

By adopting this arrangement, the embodiment ensures that even a minor density variation caused by the shortage of residual toner, when the residual toner runs low, can be visually recognized as the density difference between the image segments constituting the test pattern. Particularly, the density difference is enhanced by forming the test patterns on the both sides of the sheet and hence, even the general users having little specialized knowledge can visually recognize the density difference with ease. In consequence, the embodiment provides an easy determination of the degree of the image quality degradation resulting from the shortage of residual toner.

According to the second embodiment as described above, the image segments I1 to I4 constituting the test patterns of FIG. 12 are equivalent to "first reference image segment", "first evaluative image segment", "second reference image segment" and "second evaluative image segment" of the invention, respectively. The test patterns TPa and TPb including these image segments, as a whole, are equivalent to "image-quality evaluation image" of the invention.

While the individual image segments constituting the test patterns are solid images according to the second embodiment, the image pattern of the image segments is not limited to this. The image segment may have another pattern such as a half-toned image pattern. It is noted however that two image segments may preferably have the same pattern in order to provide a more discernable density difference between these image segments. Furthermore, the shape of the test pattern is not limited to the above, and may be the following patterns, for example.

Figure 16A:
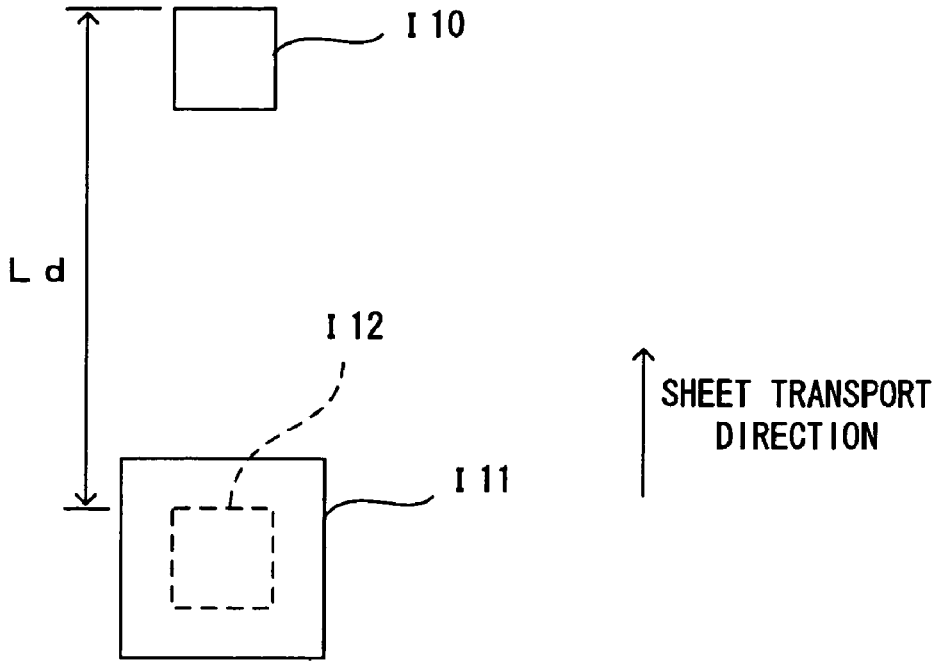
FIGS. 16A and 16B each show another exemplary test pattern.
Figure 16B:
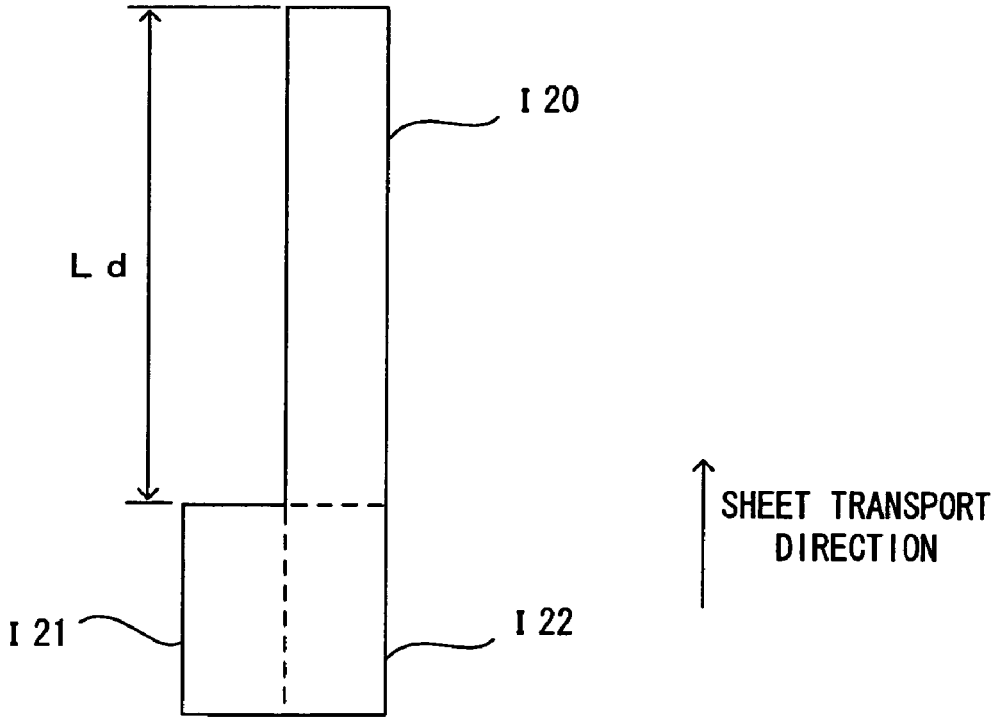

FIGS. 16A and 16B each show another exemplary test pattern. In the example of FIG. 16A, a header image segment I10 is provided forwardly of a test pattern I11 with respect to the sheet transport direction. In such a test pattern, a central portion I12 of the test pattern I11 is formed using the toner carried on a surface region of the developing roller 44, the region having the toner consumed for forming the header image segment I10 in the preceding revolution of the developing roller. That is, the "evaluative image segment" of the invention is completely enclosed by the "reference image segment" of the invention. Such an arrangement provides an easy visual recognition of the density difference because even the test pattern of a relatively small area can define a long boundary line between these image segments.

In the example of FIG. 16B, a header image segment I20 and an image segment I22 equivalent to the first evaluative image segment are formed in a continuous manner. In this arrangement as well, the degree of the image quality degradation can be evaluated from the density difference between the first reference image segment I21 and the first evaluative image segment I22, jus as in the above embodiment. In the test pattern of the above embodiment and the exemplary modifications thereof, each of the image segments has a rectangular or square shape. However, these image segments may also have arbitrary shapes.

Although the above embodiment is adapted to output the status sheet having the aforementioned test pattern after the display of the near-end message related to at least one of the four toner colors, the output of the status sheet is not limited to this. For instance, the status sheet may be outputted irrespective of the residual toner quantity but in response to the demand from the user or the external apparatus. Otherwise, the status sheet may be outputted irrespective of the external demand but in response to the displayed near-end message related to any one of the toner colors. On the other hand, the status sheet S does not always need be formed with the test pattern of all the toner colors. For instance, the test pattern may be formed only in a toner color that is related to the displayed near-end message.

While the above embodiment forms one set of test patterns of the respective toner colors on the status sheet, as shown in FIG. 15, there may be formed plural sets of test patterns. In the light of a fact that the eccentricity or flexure of the cylindrical photosensitive member 22 or developing roller 44 tends to cause the image density variations along an axial direction thereof, for example, the test patterns of the respective colors may be formed at plural places along the axial direction or a direction perpendicular to the sheet transport direction.

Third Embodiment

Figure 17A:
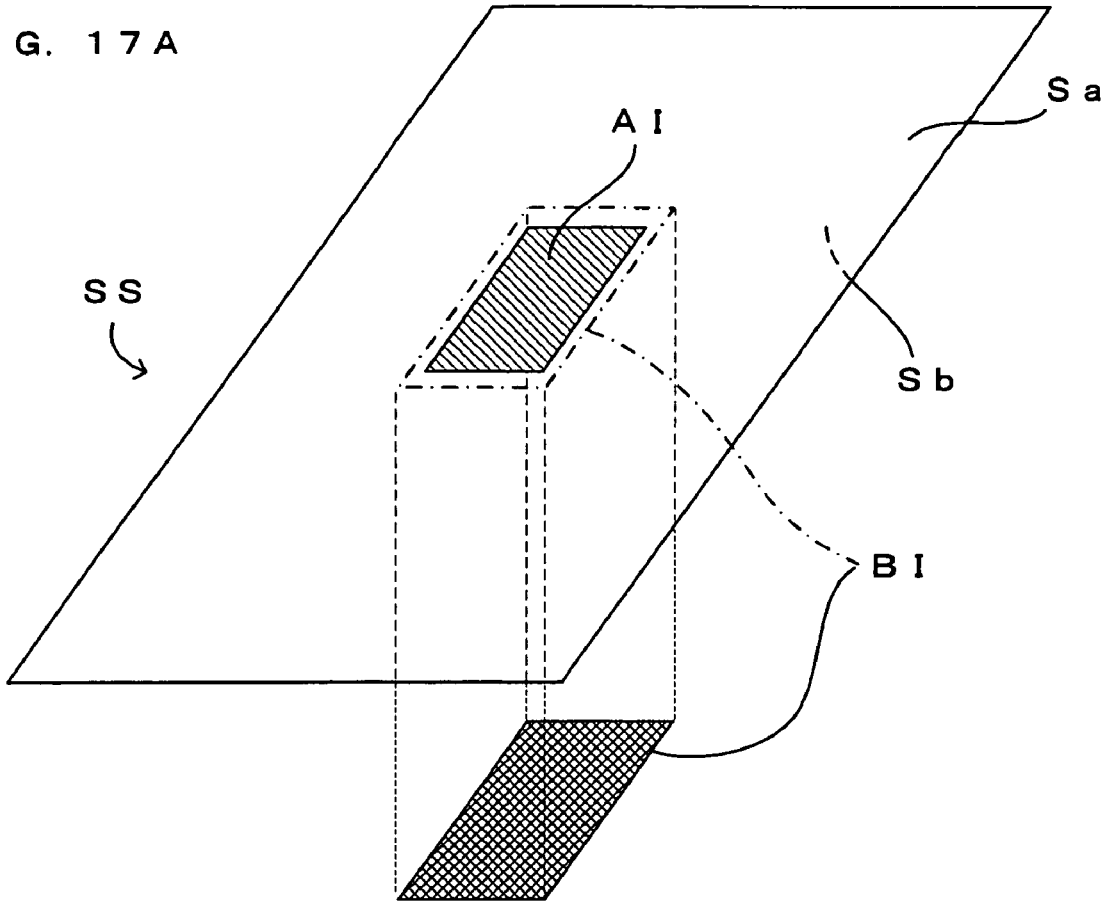
FIGS. 17A and 17B are diagrams showing an example of a status sheet according to a third embodiment.
Figure 17B:
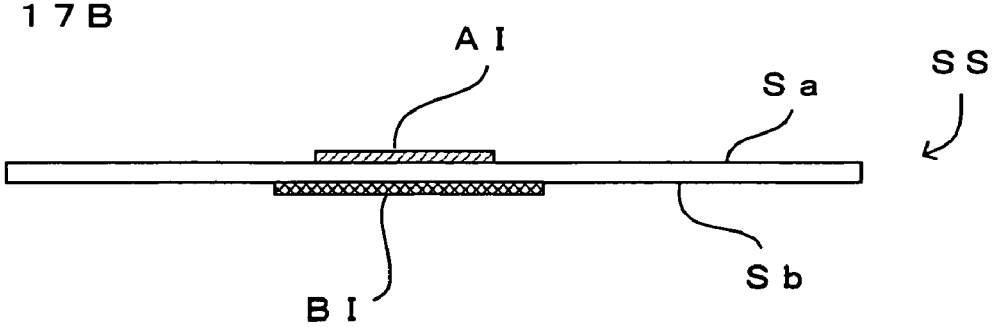

FIGS. 17A and 17B are diagrams showing an example of a status sheet according to a third embodiment. More specifically, FIG. 17A is a perspective view of the status sheet, whereas FIG. 17B is a sectional view thereof. The status sheet SS is obtained by the engine EG which forms predetermined images on the both sides of the sheet S as the recording medium. Specifically, an image-quality evaluation image AI is formed on the one side Sa of the sheet S, whereas a background image BI is formed on the other side Sb of the sheet S.

The image-quality evaluation image AI is a monochromatic image formed in a toner color, in which the user desires to check the image quality. That is, the monochromatic image is formed in the toner color related to the displayed near-end message. In the interest of easy checking of the image defects, such as fading or density variations, caused by the shortage of residual toner, the image-quality evaluation image may preferably be a solid image or a half-toned image of a relatively higher tone level, which substantially has a uniform image pattern and a sufficient area for allowing the checking of the image quality by visual inspection.

In cases, the general users having little specialized knowledge may find it difficult to judge the quality of the image-quality evaluation image AI thus formed. Such a case is exemplified by a yellow monochromatic image formed on a white sheet. The yellow color is less visible in nature. Therefore, if the image-quality evaluation image AI should sustain some image defects such as fading or density variations, it is not easy for the user, who is not properly trained for it, to find such defects.

On the opposite side from the side where the image-quality evaluation image AI is formed, therefore, the background image BI is formed in a manner to cover a background of the image-quality evaluation image AI, thereby making the image-quality evaluation image AI more visible. This is because the background image formed on the opposite side from the image-quality evaluation image AI supposedly suppresses light reflection on or light transmittance from the back side of the sheet. As shown in FIG. 16, the background image BI may preferably be formed in such a shape and size as to completely cover an outside periphery of the image-quality evaluation image AI as seen through the sheet S from the image-quality evaluation image AI side. In addition, the background image may preferably have a substantially uniform image pattern such as of a solid image or a half-toned image of a constant tone level.

For further enhancing the visibility of the image-quality evaluation image, the background image may preferably have a different color from that of the image-quality evaluation image AI, or particularly, a more visible color than that of the image-quality evaluation image AI. According to the findings obtained by the present inventors, the black color is the most visible against the white sheet S. The visibility is progressively lowered in the order of cyan and magenta and the yellow color is the least visible. That is, the brighter, lighter color is the less visible. Against the yellow image-quality evaluation image AI, for example, any of the other three colors can be described as suitable for the background image. Above all, the black color having the highest light absorptivity is particularly effective.

According to the findings obtained by the present inventors, a certain correlation exists between the spectral reflection characteristic per toner color and the visibility of the toner color. Specifically, a toner having a high light reflectivity in a relatively broad range of the visible spectral band tends to be decreased in the visibility because of its reflection characteristic resemblant to that of the white sheet. In contrast, a toner having a high light reflectivity in a relatively narrow range of the visible spectral band or a low light reflectivity has higher visibility. Among the four color toners used in the embodiment, the yellow toner has the highest light reflectivity in the visible spectral band and presents the high light reflectivity in a broader range. Therefore, the yellow color is the least visible of the four toner colors. The reflectivity decreases in the order of magenta, cyan and black, whereas the visibility increases in this order.

The image-quality evaluation image AI is desirably formed as the monochromatic image because of the necessity of checking the image quality for a specific toner color, whereas no such limitation is imposed on the background image BI. That is, unless the background image has a color or pattern interfering with the visibility of the image-quality evaluation image AI, the background image BI may have a mixed color of two or more toner colors.

The status sheet SS may be outputted, as further including any other image than the above. For instance, a product logo as well as a variety of information items may be outputted along with the image-quality evaluation image AI and the background image BI, thereby increasing the efficiency of maintenance service done by the user or a service staff. The information items includes one indicative of the service lives of the individual parts of the apparatus, one indicative of set values of operating conditions, one indicative of the number of images to be formed and the like. Furthermore, if the residual quantities of toners in the developers at the current point of time are outputted, the user can more correctly figure out time to replace the developer.

Figure 18:
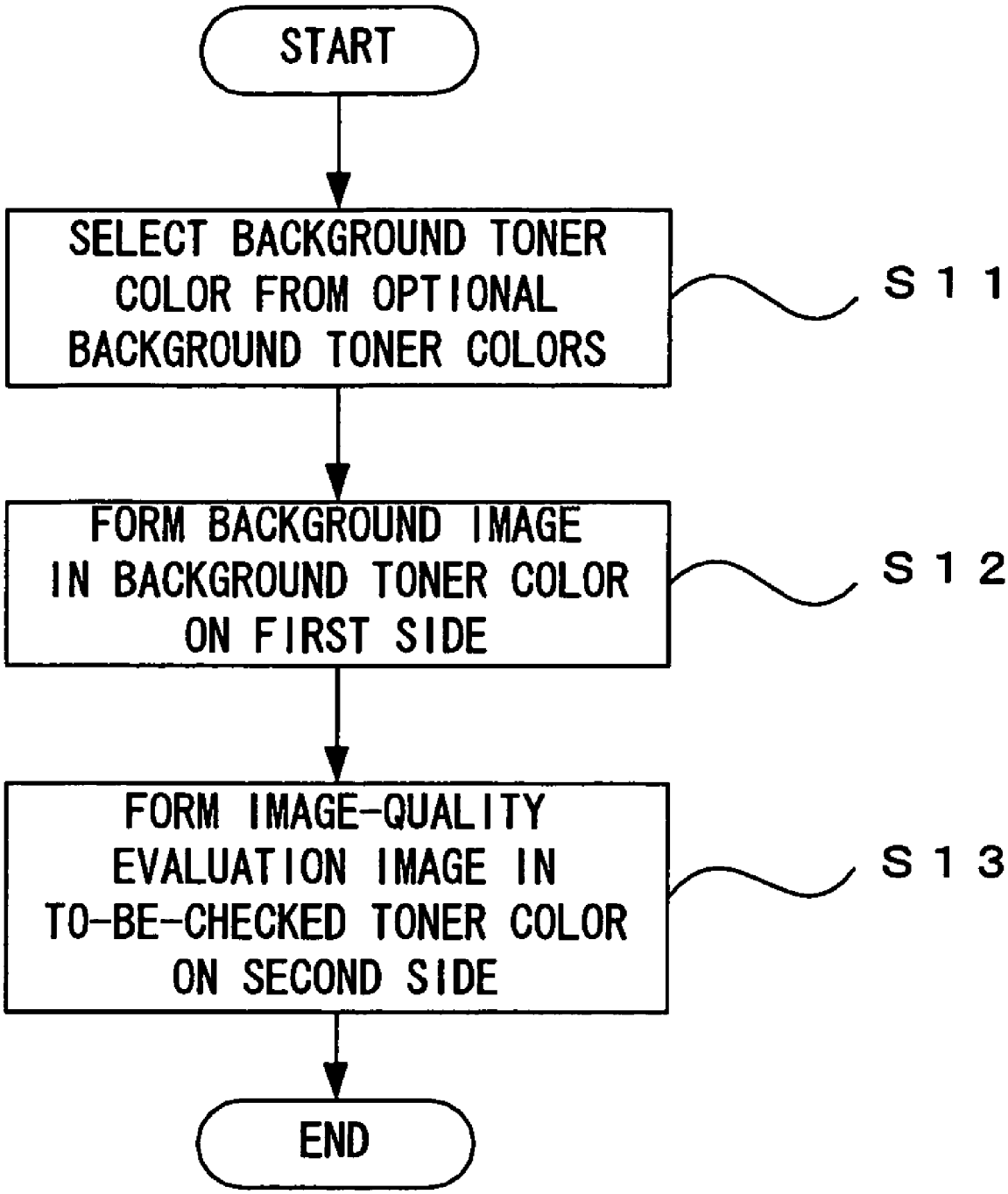
FIG. 18 is a flow chart showing the steps of a procedure for obtaining the status sheet.

FIG. 18 is a flow chart showing the steps of a procedure for obtaining the status sheet. FIG. 19 is a chart showing the toner colors of the image-quality evaluation image and the background image. In Step S11, a background toner color is selected from the toner colors exclusive of a toner color subjected to the image quality checking, or the toner color related to the displayed near-end message. It is noted here that the options for the background toner color are those more visible than the toner color subjected to the image quality checking. When the toner color subjected to the image quality checking (to-be-checked toner color) is yellow, as shown in FIG. 19, the toner colors as the options for the background image color (optional background toner color) are the other three colors, magenta, cyan and black. In a case where the to-be-checked toner color is magenta, cyan and black are the optional background toner colors. In a case where the to-be-checked toner color is cyan, black is the optional background toner color. Incidentally, the black color has high visibility because of its high light absorptivity and hence, it is easy to check the quality of black image without the background image. Accordingly, the black image-quality evaluation image may be not provided with the background image.

Now, description will be made on which of the optional background toner colors is selected as the background toner color. As described above, the black color having the highest light absorptivity forms the most effective background image. Therefore, the easiest way is to select black as the background toner color whichever of yellow, magenta and cyan is the to-be-checked toner color. However, there may be a case where the other color than black is more suitable as the background toner color. In a case where the residual quantity of black toner is very low, for example, it is more preferred to form the background image with the toner of the other color, because the black toner may run out as consumed for forming the background image. In addition, if the background image sustains the image defects, the image no longer plays the role of the background image. From this viewpoint, it is also possible to select, from the toners of the optional background colors, a toner remaining in the developer in the greatest quantity. This approach obviates the problem that the toner is used up by forming the background image, or that the background image itself sustains the image defects.

Alternatively, the following method may be adopted. In a case where a sufficient quantity of black toner remains, or where the near-end message is yet to be displayed with respect to the black toner, for example, the black color may be selected as the background toner color irrespective of the residual quantity of black toner. On the other hand, in a case where the residual black toner runs low so as to come closer to the display of the end message, one of the other optional background toner colors, that has the highest visibility (or that has the greatest residual quantity), may be selected as the background toner color. According to still another method, when the residual black toner runs low, the background image may be formed in a mixed color of the black color and another toner color, thereby reducing the consumption of the back toner.

In a case where plural toner colors are to be checked, a toner color satisfying the relations with all the to-be-checked toner colors, as shown in FIG. 19, may be selected as the background toner color. In a case where the near-end messages are displayed with respect to the yellow and cyan colors, for example, these two colors are the to-be-checked toner colors and hence, the background toner color in this case is limited to the black color. However, the background toner color is not limited to this if discrete image-quality evaluation image and background image are formed for each of the to-be-checked toner colors.

Returning to FIG. 18, the description on the procedure for obtaining the status sheet is continued. In the subsequent Step S12, the engine EG performs the image forming operation for forming the background image BI in the background toner color thus selected on one side (first side) of the sheet S taken out from the cassette 8. Subsequently, the image-quality evaluation image AI is formed in the to-be-checked toner color on the other side (second side) of the sheet S (Step S13). The terms "first side" and "second side" mean to designate the respective sides of the sheet S in the order of forming the images. In contrast, a "first primary side" and a "second primary side" of the invention designate a "side on which the image-quality evaluation image is formed" and a "side on which the background image is formed", respectively, thus representing a different concept from that of the above "first side" and "second side". According to the embodiment, of the both sides of the sheet S, the side Sa formed with the image-quality evaluation image AI is equivalent to "the first primary side" whereas the side Sb formed with the background image is equivalent to "the second primary side".

Figure 20A:
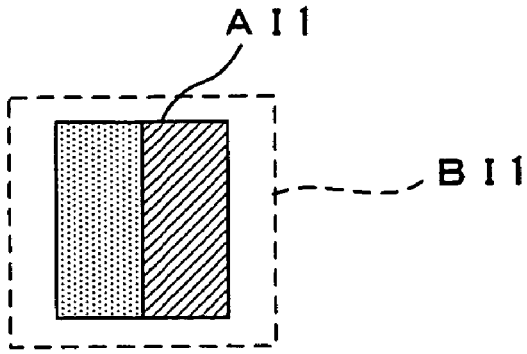
FIGS. 20A to 20D are diagrams each showing an example of the image-quality evaluation image and background image.
Figure 20B:
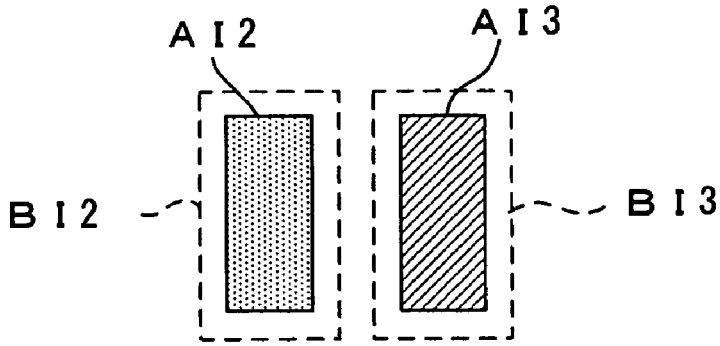
Figure 20C:
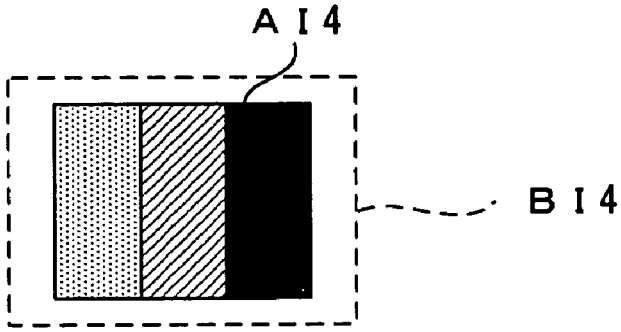

FIGS. 20A to 20D are diagrams each showing an example of the image-quality evaluation image and background image. FIGS. 20A to 20C all show the image patterns on the both sides of the status sheet SS as seen from one side Sa thereof, while the outside periphery of the background image on the other side Sb side is indicated by the broken line. Firstly, in a case where the to-be-checked toner color is only one color, the background image BI may be formed on the back side of the sheet S at place corresponding to the image-quality evaluation image AI of the toner color in question, as shown in FIG. 17A. On the other hand, in a case where two or more toner colors are to be checked, there may be formed an image-quality evaluation image AI1 consisting of monochromatic image-quality evaluation image segments of the respective to-be-checked toner colors, and a background image BI1 in covering relation with the above image, as shown in FIG. 20A. In this case, the individual image segments may adjoin each other, or may be spaced from each other. As shown in FIG. 20B, discrete image-quality evaluation images AI2 and AI3 may be formed in the respective to-be-checked toner colors, while background images BI2 and BI3 may be formed in correspondence to the respective image-quality evaluation images. In this case, the background images BI2 and BI3 need not be in the same color.

Figure 20D:
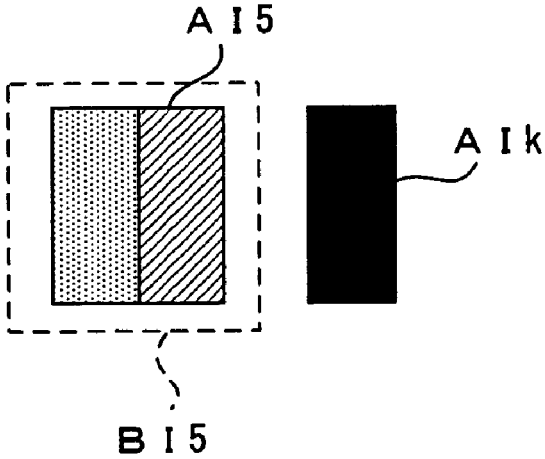

In a case where the toner colors to be checked include black, there may be formed an image-quality evaluation image AI4 including a black image segment, and a background image BI4 in covering relation with the above image, as shown in FIG. 20C. Alternatively, as shown in FIG. 20D, an image-quality evaluation image AI5 consisting of image segments of colors other than black may be formed in a manner to be covered by a background image BI5, while a black image segment AIk may be formed at place outside the area covered by the background image BI5. This is because the existence of the background image does not exert a significant influence on the visibility of the black color, as described in the foregoing.

As shown in FIG. 18, the embodiment obtains the status sheet SS by successively forming the images on the both sides of the sheet S. In this process, the background image is formed on the side of the sheet S that is firstly subjected to the image formation (the first side) and then, the image-quality evaluation image is formed on the other side that is subjected to the image formation subsequently (the second side). According to the embodiment, of the status sheet SS shown in FIG. 16, the side Sb formed with the background image BI defines the first side firstly subjected to the image formation, whereas the side Sa formed with the image-quality evaluation image defines the second side subjected to the image formation subsequently. The reason for forming the images in this manner is as follows.

In the image forming apparatus of this type, the efficiency of transferring the toner image to one side of the recording medium varies depending upon whether the other side is formed with the image or not. That is, if the image is already formed on one side, the transfer efficiency on the other side is lowered. In the apparatus adapted to form images on the back and front sides of the recording medium in turn, the transfer efficiency is lower on the side formed with the image later or the second side than on the first side and hence, the image defects are more likely to occur on the second side. Particularly in a state where the residual toner runs low or the toner is deteriorated in the properties thereof, the drop of the transfer efficiency is significant.

If the image-quality evaluation image is formed on the first side and then, the background image is formed on the second side, a fear exists that the background image may sustain the image defects so that the visibility of the image-quality evaluation image is impaired or that the degraded quality of the image of the to-be-checked toner color, which possibly occur on the second side, may be overlooked. In contrast, if the image-quality evaluation image for checking the degree of the image quality degradation is formed on the second side as suggested by the third embodiment, the background image may be prevented from sustaining the image defects and besides, the image defects possibly appearing on the image-quality evaluation image become more noticeable.

According to the third embodiment as described above, the status sheet SS formed with the image-quality evaluation image on one side of the sheet S is outputted and submitted for the user's checking operation for the image quality. In this case, the background image is formed on the opposite side from the side formed with the image-quality evaluation image, and at place corresponding to the image-quality evaluation image. Thus, the visibility of the image-quality evaluation image is enhanced to facilitate the judgment of the image quality. For instance, the fading or density variations, which may appear on the image in association with the low residual quantity of toner in the developer, can be identified correctly. For the purpose of enhancing the visibility, in particular, it is preferred to form the background image in a different color from that of the image-quality evaluation image and in a manner to cover the overall background area of the image-quality evaluation image. When the background image is formed particularly using the toner of a more visible color than that of the image-quality evaluation image, the background image may exert a dramatic effect. From this viewpoint, the black toner having the highest light absorptivity is the most suitable as the background toner.

The yellow-toner monochromatic image formed on the white sheet, for example, is less visible and hence, the general users may find it difficult to evaluate the quality of such an image. In this case, the background image of a different color may be formed on the opposite side from the image-quality evaluation image, whereby the image-quality evaluation image is improved in the visibility to facilitate the judgment of the image quality.

In a case where a plurality of toner colors are usable for the background image, a toner having the greatest residual quantity among these toners may be used, whereby those problems including the image defects on the background image, the toner end resulting from the formation of the background image and such may be obviated.

Of the both sides of the sheet S, the side to be formed with the image later encounters the decrease of transfer efficiency and is more susceptible to the image defects, as compared with the side to be firstly formed with the image. With this in view, the background image is formed on the side to be firstly formed with the image, thereby preventing the background image from sustaining the image defects. Furthermore, the image defects possibly occurring on the image-quality evaluation image are made more noticeable by forming the image-quality evaluation image on the side to be formed with the image later.

As described above, Steps S12 and S13 in the flow chart of FIG. 18 are equivalent to "background image forming step" and "image-quality evaluation image forming step" of the invention, respectively.

While the images substantially having the uniform image patterns, such as solid image and half-toned image, are used as the image-quality evaluation image in the above third embodiment, the image-quality evaluation image is not limited to these. Character images and thin line images, for example, may also be used as the image-quality evaluation image.

According to the above embodiment, for example, the CPU 101 determines the residual quantity of toner in each of the developers based on the toner consumption calculated by the toner counter 200, and forms the image-quality evaluation image only in the color of the toner, the residual quantity of which is below the predetermined value (or the near-end message of which is displayed), in response to the user demand. However, an alternative method may also be adopted. Irrespective of the residual toner quantity, for instance, the status sheet containing the image-quality evaluation image and the background image may be outputted whenever the user demands it. Furthermore, the image-quality evaluation image for all the toner colors may also be formed irrespective of the levels of the residual toner quantities.

According to the above embodiment, one pair of the image-quality evaluation image and background image are formed centrally of the status sheet SS, as shown in FIG. 16. However, these images may also be formed in plural pairs. In the light of the fact that the eccentricity or flexure of the cylindrical photosensitive member 22 or developing roller 44 tends to cause the image density variations along the axial direction thereof, for example, respective pairs of the image-quality evaluation image and background image may be formed at plural places along the axial direction.

Fourth Embodiment

Figure 21A:
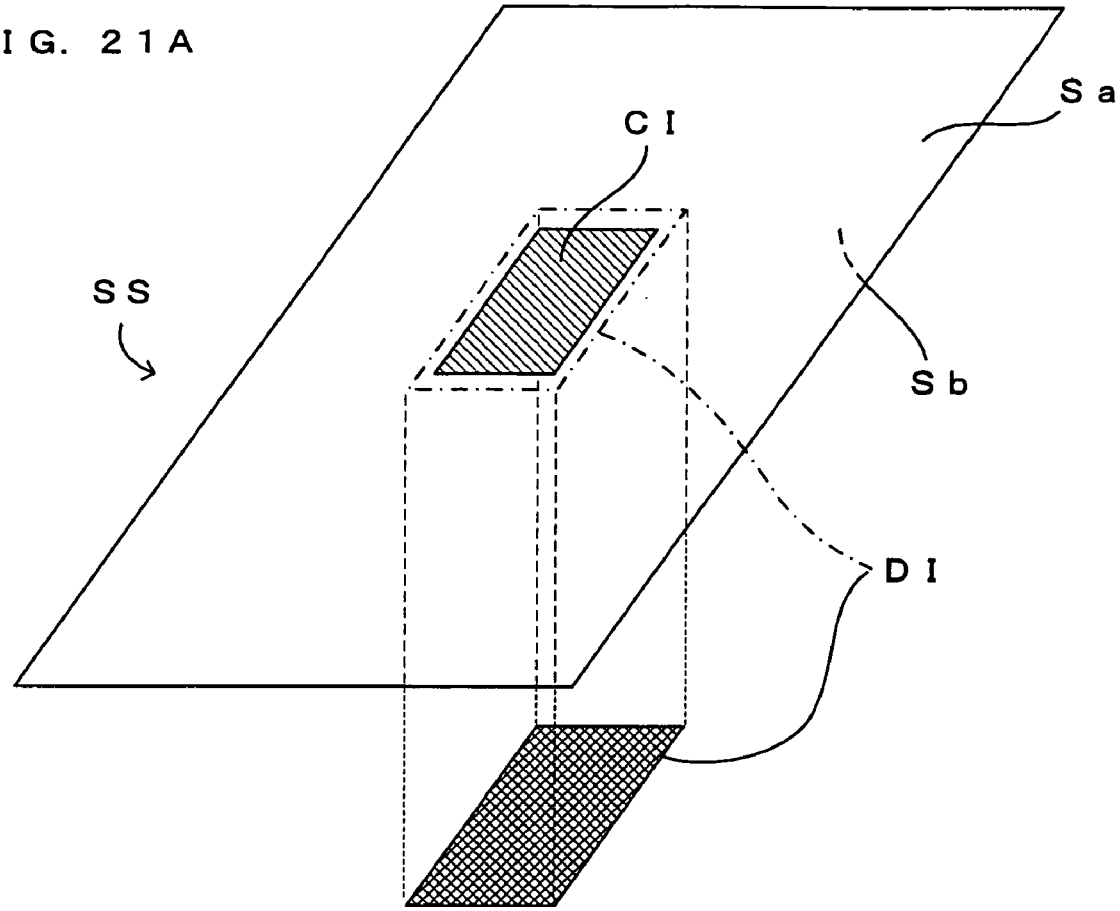
FIGS. 21A and 21B are diagrams showing an exemplary status sheet according to a fourth embodiment.
Figure 21B:
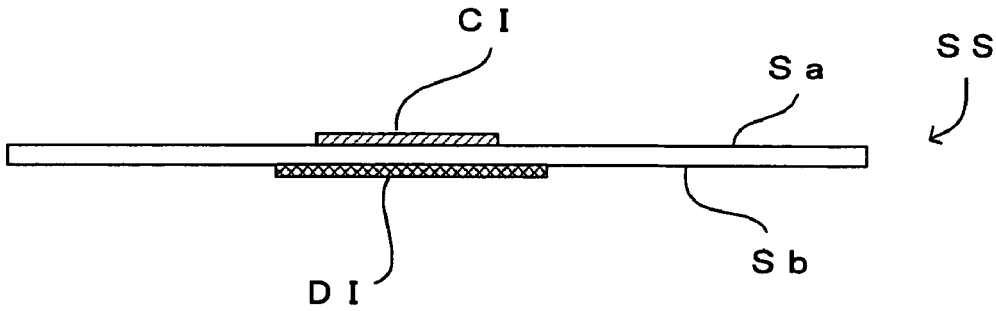

FIGS. 21A and 21B are diagrams showing an exemplary status sheet according to a fourth embodiment. More specifically, FIG. 21A is a perspective view of the status sheet, whereas FIG. 21B is a sectional view thereof. The status sheet SS is obtained by the engine EG forming predetermined images on the both sides of the sheet S as the recording medium. Specifically, an image-quality evaluation image CI is formed on the one side Sa of the sheet S. A background image DI is formed on the other side Sb of the sheet S. Thus, the status sheet SS is obtained by forming the images of the predetermined patterns on the both sides of the sheet S.

As mentioned supra, the image forming apparatus forms the images on the both sides of the sheet S by first forming the image on one side of the sheet S and then, reversing the sheet S, followed by forming the image on the other side of the sheet S. Of the both sides of the sheet S, a side firstly formed with the image will be hereinafter referred to as "the first side", whereas the side formed with the image subsequently will be referred to as "the second side". When the image forming apparatus obtains the aforementioned status sheet SS, the background image DI is formed on the first side of the sheet S and the image-quality evaluation image CI is formed on the second side. According to the embodiment, the one side Sa of the status sheet SS that is formed with the image-quality evaluation image CI defines the second side formed with the image later, whereas the side Sb formed with the background image defines the first side firstly formed with the image. The reason for defining the sides of the sheet in this manner is as follows.

The image forming apparatus of this type has the nature that when transferring the toner image from the intermediate transfer belt 71 onto the sheet S, the transfer efficiency is lowered if the image is already formed on the back side (the opposite side from a transfer side to which the toner image is transferred). This is because the insulating toner adhered to the back side of the sheet supposedly interferes with the toner transfer to the transfer side. In the image forming apparatus of this type, the transfer efficiency is lower on the second side than on the first side. Particularly after the display of the near-end message, therefore, serious image defects are likely to occur due to the low residual toner quantity, the deterioration of the toner and the lowered transfer efficiency.

It is noted here that the status sheet SS is obtained for the purpose of checking how much the actually formed image is degraded in quality according to the conditions of the apparatus. That is, the image-quality evaluation image CI must reflect the conditions of the apparatus. Therefore, in a case where there is a fear that the apparatus may be in such conditions as to entail the image defects, the significance of forming the image-quality evaluation image will be negated unless the image-quality evaluation image is assuredly adapted to suggest the possible occurrence of the image defects.

Hence, the embodiment takes the advantage of the aforementioned nature related to the two-side image formation or that the transfer efficiency is lower on the second side than on the first side, thereby ensuring that the image-quality evaluation image CI properly reflects the conditions of the apparatus. That is, the background image DI is previously formed on the first side Sb of the status sheet SS and then, the image-quality evaluation image CI is formed on the second side Sa at place corresponding to the background image DI. Thus, the image-quality evaluation image CI is formed on the side Sa of the sheet S at a region, to the back side of which region the toner is adhered. In the image-quality evaluation image CI, therefore, the image defects associated with the deterioration of the apparatus appear in a more visible manner. Hence, the user can judge the image quality easily.

Furthermore, the fear of the occurrence of image defects on the background image DI is decreased by forming the background image DI in the sate where the image defects are less likely to occur. Therefore, it is also possible to prevent the visibility of the image-quality evaluation image CI from being impaired by the fading or density variations of the background image DI.

Next, the image patterns of the image-quality evaluation image CI and the background image DI will be described in more details. The image-quality evaluation image CI is a monochromatic image formed in a toner color, for which the user wants to check the image quality, or the monochromatic image formed in the toner color related to the displayed near-end message. It is also desirable that the image-quality evaluation image CI is a solid image or half-toned image of a relatively high tone level substantially having a uniform image pattern such as to make the image defects, such as fading and density variations, more noticeable, the defects resulting from the shortage of residual toner, and that the image-quality evaluation image CI has a sufficient area for allowing the checking of the image quality by visual inspection.

In cases, the general users having little specialized knowledge may find it difficult to judge the quality of the image-quality evaluation image CI thus formed. Such a case is exemplified by a yellow monochromatic image formed on a white sheet. The yellow color is less visible in nature. Therefore, if the image-quality evaluation image CI should sustain some image defects such as fading or density variations, it is not easy for the user, who is not properly trained for it, to find such defects.

According to the findings obtained by the present inventors, it is possible to increase the visibility of such a toner color inherently less visible by forming the background image DI in a more visible toner color, such as black. This is because the background image supposedly suppresses light reflection on or light transmittance from the back side of the sheet, thereby increasing contrast between the image-quality evaluation image CI and the sheet S. Against the white sheet S, the black color is the most visible and the visibility is decreased in the order of cyan and magenta. The yellow color is the least visible. In other words, the brighter, lighter color is the less visible. Against the yellow image-quality evaluation image CI, for example, any of the other three colors can be described as suitable for the background image. Above all, the black color having the highest light absorptivity is particularly effective.

Further according to the findings obtained by the present inventors, a certain correlation exists between the spectral reflection characteristic per toner color and the visibility of the toner color. Specifically, a toner having a high light reflectivity in a relatively broad range of the visible spectral band tends to be decreased in the visibility because of its reflection characteristic resemblant to that of the white sheet. In contrast, a toner having a high light reflectivity in a relatively narrow range of the visible spectral band or a low light reflectivity has higher visibility. Among the four color toners used in the embodiment, the yellow toner has the highest light reflectivity in the visible spectral band and presents the high light reflectivity in a broad range. Therefore, the yellow color is the least visible of the four toner colors. The reflectivity decreases in the order of magenta, cyan and black, whereas the visibility increases in this order.

In the case of the image-quality evaluation image of a toner color, such as black, which inherently has a relatively higher visibility, on the other hand, the color of the background image DI does not exert a significant influence on the visibility of the image-quality evaluation image CI. Furthermore, the degree of the decrease of transfer efficiency on the second side is not much affected by the color of the toner adhered to the first side. In this respect, the color of the background image DI may be arbitrarily selected. However, it is more preferred that the color of the background image has a lower visibility than the toner color of the image-quality evaluation image CI. Thus, the influence of the color of the background image DI on the visibility of the image-quality evaluation image CI may be minimized.

As shown in FIGS. 21A and 21B, the background image DI may preferably be formed in such a shape and size as to completely cover the outside periphery of the image-quality evaluation image CI as seen through the sheet S from the image-quality evaluation image CI side. In addition, the background image may preferably have a substantially uniform image pattern such as of a solid image or a half-toned image of a constant tone level.

The image-quality evaluation image CI may preferably be a monochromatic image because of the necessity of checking the image quality for a specific toner color, whereas no such limitation is imposed on the background image BI. That is, unless the background image has a color or pattern interfering with the visibility of the image-quality evaluation image CI, the background image DI may have a mixed color of two or more toner colors.

The status sheet SS may be outputted, as further including any other image than the above. For instance, a product logo as well as a variety of information items may be outputted along with the image-quality evaluation image CI and the background image DI, thereby increasing the efficiency of maintenance service done by the user or a service staff. The information items includes one indicative of the service lives of the individual parts of the apparatus, one indicative of set values of operating conditions, one indicative of the number of images to be formed and the like. Furthermore, if the residual quantities of toners in the developers at the current point of time are outputted, the user can more correctly figure out time to replace the developer.

Figure 22:
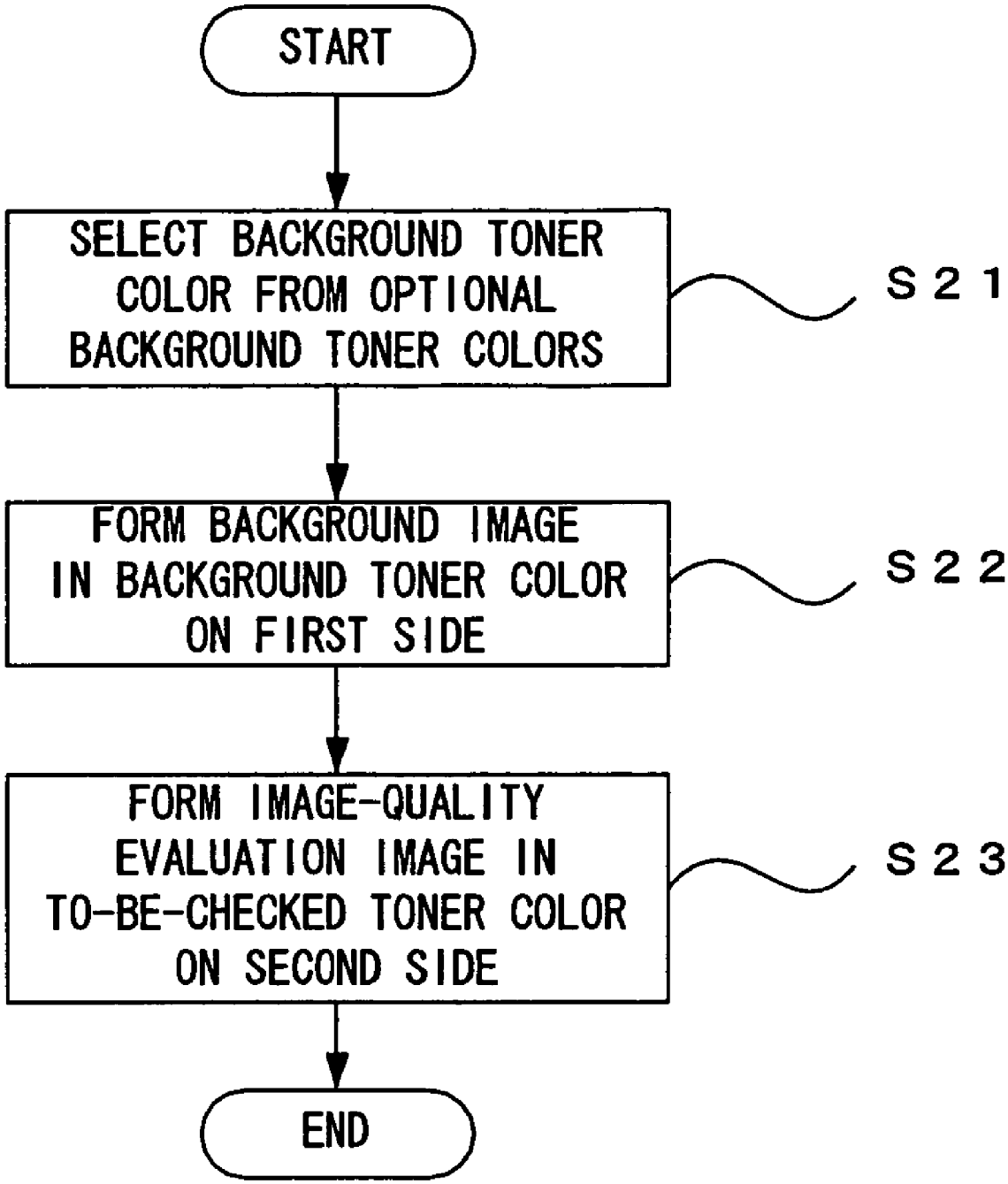
FIG. 22 is a flow chart showing the steps of a procedure for obtaining the status sheet in a fourth embodiment.

FIG. 22 is a flow chart showing the steps of a procedure for obtaining the status sheet. FIG. 23 is a chart showing the toner colors of the image-quality evaluation image and the background image. In Step S21, a background toner color is selected from the toner colors exclusive of a toner color subjected to the image quality checking, or the toner color related to the displayed near-end message. It is noted here that the options for the background toner color are those shown in FIG. 23. When the toner color subjected to the image quality checking (to-be-checked toner color) is yellow having a relatively low visibility, the background image DI is formed in any of the more visible colors of magenta, cyan and black, thereby enhancing the visibility of the image-quality evaluation image CI. When any of the more visible colors of magenta, cyan and black is the to-be-checked toner color, the background image is formed in the less visible color of yellow, thereby preventing the background image from interfering with the visibility of the image-quality evaluation image CI.

Provided that plural colors are available as the options for background toner color, description is made on which of the optional background toner colors is selected as the background toner color. In a case where the toner color to be checked is yellow, the background image of black toner having the highest light absorptivity is the most effective. Hence, the easiest way is to automatically select black as the background toner color when the to-be-checked toner color is yellow. However, there may be a case where the other color than black is more suitable as the background toner color. In a case where the residual quantity of black toner is very low, for example, it is more preferred to form the background image with the toner of the other color, because the black toner may run out as consumed for forming the background image. In addition, if the background image per se sustains the image defects, the image no longer plays the role of the background image. From this viewpoint, it is also possible to select, from the toners of the optional background colors, a toner remaining in the developer in the greatest quantity. This approach obviates the problem that the toner is used up by forming the background image, or that the background image itself sustains the image defects.

Alternatively, the following method may be adopted. In a case where the black toner remains in a sufficient quantity, or where the near-end message is yet to be displayed with respect to the black toner, for example, the black color is selected as the background toner color irrespective of the residual quantity of black toner. On the other hand, in a case where the residual black toner runs low so as to come closer to the display of the end message, one of the other optional background toner colors, that has the highest visibility (or that has the greatest residual quantity), is selected as the background toner color. According to still another method, when the residual black toner runs low, the background image may be formed in a mixed color of the black color and another toner color, thereby reducing the consumption of the back toner.

In a case where plural toner colors are to be checked, a toner color satisfying the relations with all the to-be-checked toner colors, as shown in FIG. 23, may preferably be selected as the background toner color. In a case where the near-end messages are displayed with respect to the black and cyan colors, for example, these two colors are the to-be-checked toner colors. Hence, the background toner color in this case is yellow.

On the other hand, if the to-be-checked toner colors, say yellow and magenta, do not have a common background toner color, the following methods may be adopted. In a first method, discrete background images corresponding to the respective to-be-checked toner colors may be provided. This method permits every one of the to-be-checked toner colors to be subjected to the image quality checking in the most visible state. A second method is to form a background image of one toner color with respect to the plural toner colors to be checked. In this case, the method ends up with one to-be-checked toner color failing to satisfy the relation of FIG. 23, so that the effect of improving the visibility is slightly lowered. However, a step of forming the background image is simplified by limiting the background toner color to a single color, thereby achieving the reduction of process time.

Returning to FIG. 23, the description on the procedure for obtaining the status sheet is continued. In the subsequent Step S22, the engine EG performs the image forming operation for forming the background image DI in the background toner color thus selected on one side (the first side) of the sheet S taken out from the cassette 8. Subsequently, the image-quality evaluation image CI is formed in the to-be-checked toner color on the other side (the second side) of the sheet S (Step S23).

Figure 24A:
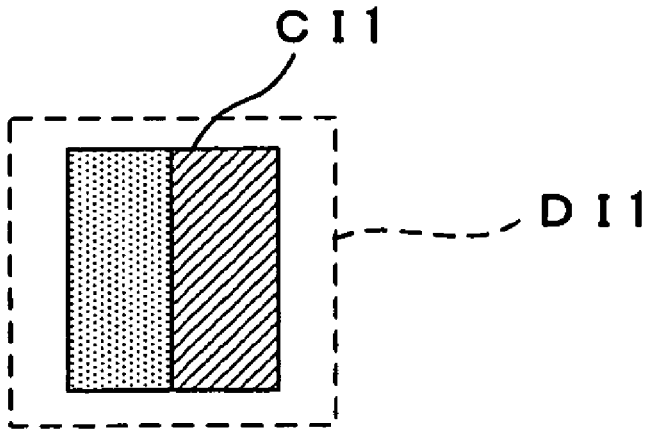
FIGS. 24A and 24B are diagrams each showing exemplary image-quality evaluation image and background image according to the fourth embodiment.
Figure 24B:
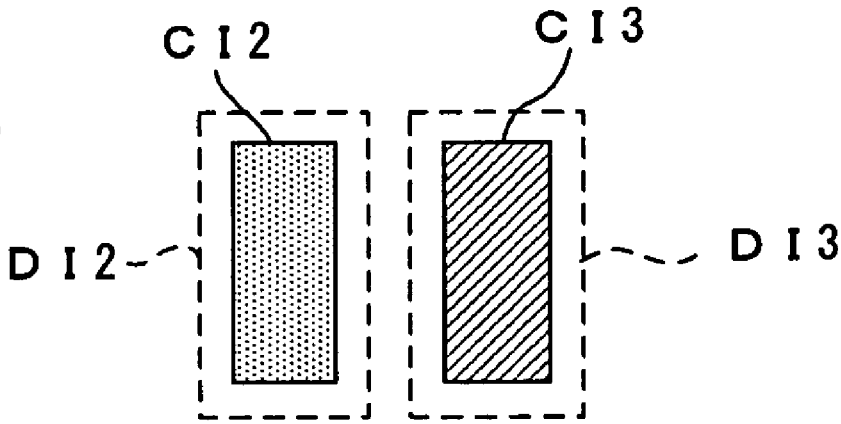

FIGS. 24A and 24B are diagrams each showing exemplary image-quality evaluation image and background image according to the fourth embodiment. These figures both show the image patterns on the both sides of the status sheet SS as seen from the one side Sa thereof, while the outside periphery of the background image on the other side Sb is indicated by the broken line. Firstly, in a case where the to-be-checked toner color is only one color, the background image DI may be formed on the back side of the sheet S at place corresponding the image-quality evaluation image CI of the toner color in question, as shown in FIG. 21A. On the other hand, in a case where two or more toner colors are to be checked, there may be formed an image-quality evaluation image CI1 consisting of monochromatic image-quality evaluation image segments corresponding to the respective to-be-checked toner colors, and a background image DI1 in covering relation with the above image, as shown in FIG. 24A. In this case, the individual image segments may adjoin each other, or may be spaced from each other. As shown in FIG. 24B, discrete image-quality evaluation images CI2 and CI3 may be formed in the respective to-be-checked toner colors, while background images DI2 and DI3 may be formed in correspondence to the respective images. In this case, the background images DI2 and DI3 need not be in the same color. That is, in a case where the background images are varied in color in correspondence to the respective to-be-checked toner colors, the image pattern shown in FIG. 24B is more preferred.

According to the fourth embodiment as described above, the status sheet SS formed with the image-quality evaluation image on one side of the sheet S is outputted and submitted for the user's checking operation for the image quality. In this case, the background image is first formed on one side of the sheet S and then, the image-quality evaluation image is formed on the other side at place corresponding to the background image. Thus, the background image is previously formed on the side first subjected to the image formation or on the first side, thereby obviating the occurrence of the image defects on the background image. On the other hand, the other side subsequently subjected to the image formation is susceptible to the image defects. Therefore, the image-quality evaluation image is formed on the second side, thereby making the image defects possibly appearing on the image-quality evaluation image more noticeable.

Furthermore, the visibility of the image-quality evaluation image is enhanced by forming the background image, so that it becomes easier to judge the image quality. For instance, the fading or density variations of the image, which may appear on the image in association with the low residual quantity of toner in the developer, can be identified correctly. For the purpose of enhancing the visibility, in particular, it is preferred to form the background image in a different color from that of the image-quality evaluation image and in a manner to cover the overall background area of the image-quality evaluation image. The yellow-toner monochromatic image formed on the white sheet, for example, is less visible and hence, the general users may find it difficult to evaluate the quality of such an image. In such a case, the background image of another color is formed on the opposite side from the image-quality evaluation image, whereby the image-quality evaluation image is improved in the visibility to facilitate the judgment of the image quality. The effect is particularly increased when the background image is formed using a toner of a more visible color than that of the image-quality evaluation image. From this viewpoint, the black color having the highest light absorptivity is the most suitable as the background toner color.

Conversely in a case where the image-quality evaluation image is formed in a toner color inherently having a high visibility, the background image contributes rather less to the increase of the visibility. Hence, the restriction on the color of the background image is looser. Therefore, the background image may be formed in a less visible color having less influence on the visibility of the image-quality evaluation image.

In a case where plural toner colors are available for the background image, one of these toners, that has the greatest residual quantity, may be used. Hence, are obviated the problems that the background image sustains the image defects, that the toner is used up by forming the background image, and the like.

As described above, Steps S22 and S23 in the flow chart of FIG. 22 are equivalent to "the background image forming step" and "the image-quality evaluation image forming step" of the invention, respectively While the above embodiment uses the images substantially having the uniform image patterns, such as solid image and half-toned image, as the image-quality evaluation image, the image-quality evaluation image is not limited to these. Character images and thin line images, for example, may also be used as the image-quality evaluation image.

According to the above embodiment, for example, the CPU 101 determines the residual quantity of toner in each of the developers based on the toner consumption calculated by the toner counter 200 and forms the image-quality evaluation image only in the color of the toner, the residual quantity of which is less than the predetermined value (or the near-end message of which is displayed), in response to the user demand. However, an alternative method may also be adopted. Irrespective of the residual toner quantity, for instance, the status sheet containing the image-quality evaluation image and the background image may be outputted whenever the user demands it. Furthermore, the image-quality evaluation image for all the toner colors may also be formed irrespective of the levels of the residual toner quantities. It is noted however that the drop of the transfer efficiency on the second side is particularly significant when the residual toner runs low. Hence, the invention offers the most dramatic effect when the image-quality evaluation image is formed (or the status sheet containing this image is obtained) under such conditions.

According to the above embodiment, one pair of the image-quality evaluation image and background image are formed centrally of the status sheet SS, as shown in FIG. 20. However, these images may also be formed in plural pairs. In the light of the fact that the eccentricity or flexure of the cylindrical photosensitive member 22 or developing roller 44 tends to cause the image density variations along the axial direction thereof, for example, respective pairs of the image-quality evaluation image and background image may be formed at plural places along the axial direction.

Fifth Embodiment

Figure 25:
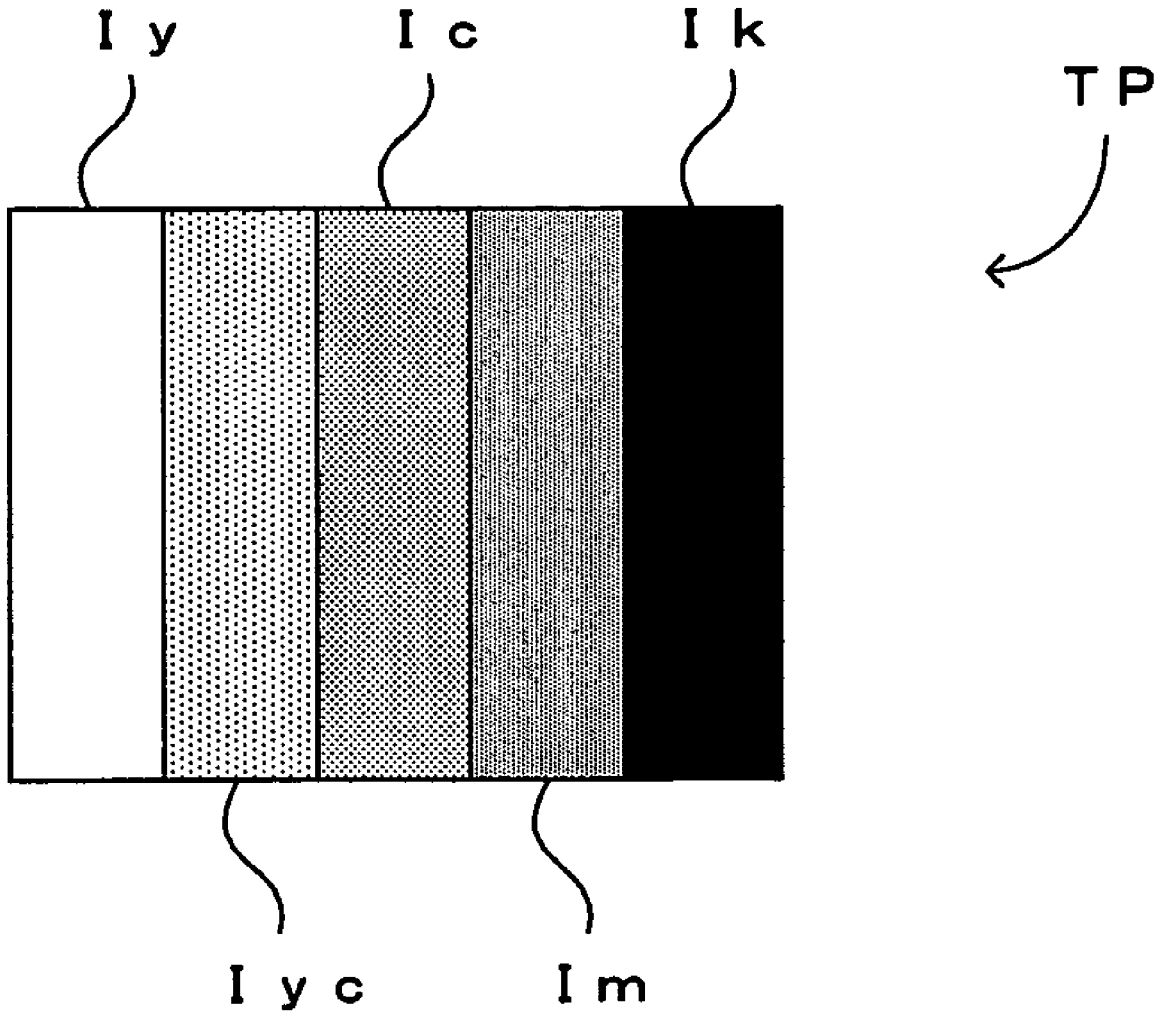
FIG. 25 is a diagram showing an exemplary test pattern according to a fifth embodiment.

FIG. 25 is a diagram showing an exemplary test pattern according to a fifth embodiment. This test pattern TP is formed when the near-end message is displayed with respect to at least the yellow toner color. The description will be made here on assumption that at least the residual quantity of cyan toner is sufficient or the near-end message thereof is yet to be displayed. This test pattern TP consists of the following five segments: a yellow monochromatic solid image Iy; a color-mixture image Iyc having the yellow and cyan colors mixed in a proper ratio; a cyan monochromatic solid image Ic; a magenta monochromatic solid image Im; and a black monochromatic solid image Ik.

The user may check the image qualities in the respective toner colors by using the test pattern TP thus arranged. Of the four toner colors, the cyan, magenta and black colors are more visible in monochrome. Therefore, the image qualities in these colors may be judged based on the degrees of fading or density variations of these monochromatic solid images.

In contrast, the yellow toner color is less visible in monochrome. Particularly, the yellow toner image formed on the white sheet is never easy for the general users to evaluate the image quality thereof. According to the findings obtained by the present inventors, a certain correlation exists between the spectral reflection characteristic per toner color and the visual perceivability (visibility) of the toner color. Specifically, a toner having a high light reflectivity in a relatively broad range of the visible spectral band tends to be decreased in the visibility because of its reflection characteristic resemblant to that of the white sheet. In contrast, a toner having a high light reflectivity in a relatively narrow range of the visible spectral band or a low light reflectivity has higher visibility. Among the four color toners used in the embodiment, the yellow toner has the highest light reflectivity in the visible spectral band and presents the high light reflectivity in a broad range. Therefore, the yellow color is the least visible of the four toner colors. The reflectivity decreases in the order of magenta, cyan and black, whereas the visibility increases in this order.

With this in view, this embodiment forms the color-mixture image Iyc having the mixed color of yellow and cyan in addition to the yellow monochromatic image. The color-mixture image Iyc is formed by superimposing a yellow half-toned image of a certain tone level (say 80%) and a cyan half-toned image of a certain tone level (say 20%) on each other on the intermediate transfer belt 71. Since the consistent half-toned images are superimposed on each other, the color-mixture image Iyc should form a substantially uniform yellow-green image. This yellow-green image has a more visible color than the yellow monochromatic image does.

Let us consider, for example, a case where the yellow half-toned image sustains the image defects such as fading and density variations resulting from the shortage of residual yellow toner. In this case, a quantity of the yellow toner at the image defect differs from that of the yellow toner at the other place. Therefore, the mixing ratio of the yellow and cyan toners varies from place to place in the color-mixture image Iyc. The variations of the toner mixing ratio result in the variations of color tone. That is, in the event of the density variations in the yellow image, the variations appear on the color-mixture image Iyc as tone irregularities. In a case where the yellow image partially contains fading, for example, a portion corresponding to the yellow fading, in the image which should originally be yellow-green, is visually perceived as green closer to the magenta color or more bluish as compared with the color of its peripheral area.

In this manner, the toner color less visible in monochrome can be replaced by the more visible color by forming the color-mixture image of the toner color and another toner color. Furthermore, the density variations are made to appear as more visible color irregularities by forming the color-mixture image, thus facilitating the judgment of the image quality. The evaluation of the image quality may also be made based on the color tone of the color-mixture image Iyc. In this case, however, an evaluator must previously know the original color tone of the image Iyc or a color sample must be obtained. According to the embodiment, on the other hand, the image quality is evaluated based on the degree of color tone variations of the image Iyc and hence, even the general users having little specialized knowledge can readily judge the image quality. In this sense, the color-mixture image Iyc may desirably be formed by superimposing the images substantially having the uniform pattern and formed in the respective colors of yellow and cyan.

By the way, this color-mixture image Iyc is formed for the sake of easier evaluation of the quality of the yellow image. Therefore, care must be taken such that the cyan color to be mixed with the yellow color is not varied in density. If the cyan color is varied in density, it is impossible to determine whether the color irregularities of the color-mixture image Iyc are caused by the yellow color or the cyan color.

In the above description, it is assumed that the residual quantity of cyan toner is sufficient and that there is no fear of the density variations of cyan color. In the actually operated apparatus, however, the cyan image may also be varied in density due to the shortage of residual cyan toner or the deterioration thereof. The embodiment forms the color-mixture image Iyc in combination with the yellow monochromatic image Iy and the cyan monochromatic image Ic which are arranged to sandwich the color-mixture image therebetween. Therefore, the evaluation may be made by comparing these monochromatic images with the color-mixture image Iyc. If the color-mixture image Iyc suffers the color irregularities while the cyan monochromatic image Ic is free from the density variations, for example, it is apparent that the yellow toner is responsible for the color irregularities of the color-mixture image Iyc. If the cyan monochromatic image Ic is also varied in density, on the other hand, it is difficult to determine whether the color irregularities of the color-mixture image Iyc are caused by the cyan toner alone or by the cyan toner and the yellow toner. In this case, it may be possible to identify the cause by cross examining the yellow monochromatic image Iy. Thus, a more exact image quality evaluation is provided by forming not only the color-mixture image Iyc but also at least one of the monochromatic images Iy, Ic of the original toner colors.

Of course, it is essentially desirable to prevent the density variations of the toner color (the toner color for mixing) to be superimposed on the yellow color. Therefore, the toner color for mixing is not previously defined but the most suitable toner color at the current point of time may be used. Suitable as the toner color for mixing is a color which improves the visibility (visual perceivability) of the color-mixture image as mixed with the yellow color subjected to the evaluation. In this respect, the black color is not suited so much because the black color does not contribute to the enhancement of the visibility of the color-mixture image, although it varies the lightness of the image. In contrast, the magenta and cyan colors are both effective to enhance the visibility. While these toner colors are both usable as the toner color for mixing, it is preferred to use either one of these that satisfies a condition to suppress the occurrence of density variations. The embodiment decides the toner color for mixing as follows.

FIG. 26 is a chart illustrating a method of deciding the toner color for mixing. In FIG. 26, "prior-to near-end" indicates a state where the near-end message is yet to be displayed or where the residual toner quantity is above a reference value. On the other hand, "subsequent-to near-end" indicates a state where the residual toner quantity is below the reference value so that the near-end message or the end message is displayed. In order to prevent the toner color for mixing from being varied in density, this embodiment uses either of the cyan and magenta toners that is greater in residual quantity. Specifically, if the cyan color is in the prior-to near-end state, the cyan color, free from the fear of density variations, is decided as the toner color for mixing. If the cyan color is in the subsequent-to near-end state whereas the magenta color is in the prior-to near-end state, the magenta color, free from the fear of density variations, is selected as the toner color for mixing. In a case where both of these colors are in the subsequent-to near-end state, either one of them that is greater in the residual quantity is selected as the toner color for mixing. By deciding the toner color for mixing in this manner, the possibility of the density variations of the toner color for mixing is decreased, so that the evaluation of image quality on the yellow toner color may be made easily.

The status sheet may be outputted, as further including any other image than the above. For instance, a product logo as well as a variety of information items may be outputted along with the test pattern TP, thereby increasing the efficiency of maintenance service done by the user or a service staff. The information items includes one indicative of the service lives of the individual parts of the apparatus, one indicative of set values of operating conditions, one indicative of the number of images to be formed and the like. Furthermore, if the residual quantities of toners in the developers at the current point of time are outputted, the user can more correctly figure out time to replace the developer.

Figure 27:
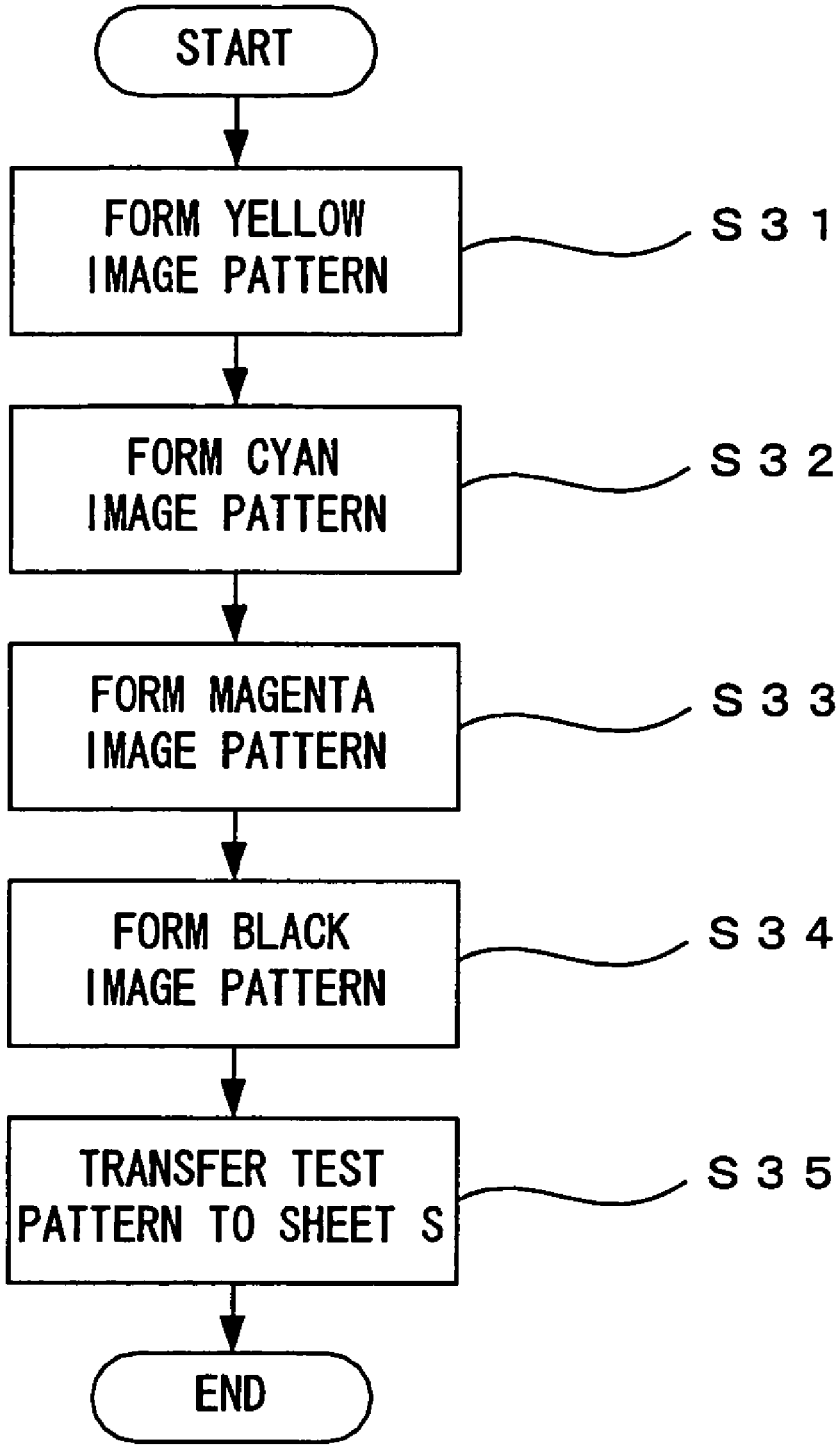
FIG. 27 is a flow chart showing the steps of a procedure for obtaining the status sheet.
Figure 28:
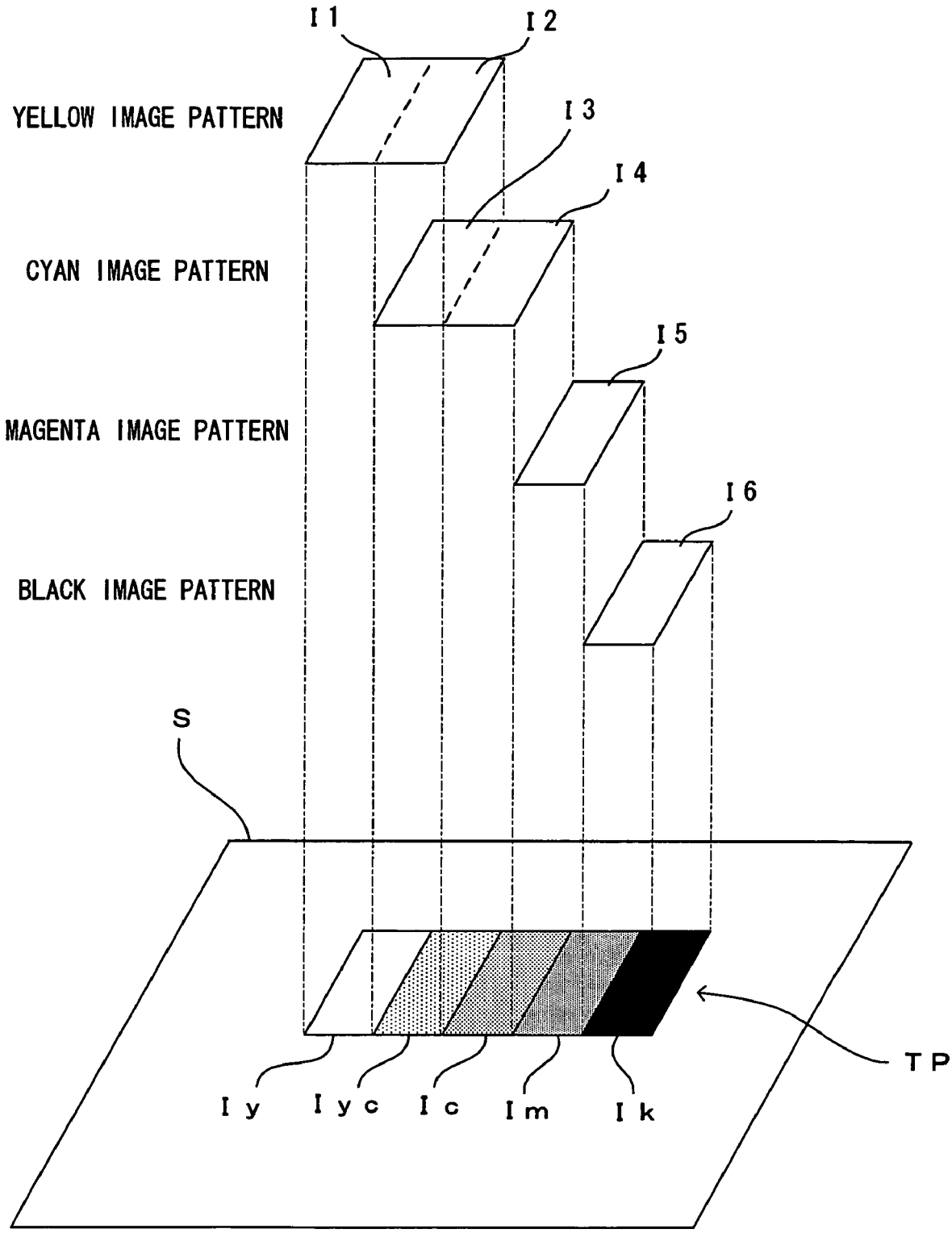
FIG. 28 is a diagram showing the respective image patterns of the toner colors.

FIG. 27 is a flow chart showing the steps of a procedure for obtaining the status sheet. FIG. 28 is a diagram showing the respective image patterns of the toner colors. The status sheet is obtained by transferring the test pattern TP to the sheet S, the test pattern formed by superimposing the images with each other on the intermediate transfer belt 71, the images having the respective toner colors and image patterns shown in FIG. 28. The following description will be made by way of example of a case where the cyan color is used as the toner color for mixing. First, the yellow developer 4Y is operated to form a yellow image pattern (Step S31). As shown in FIG. 28, the yellow image pattern includes a solid image segment I1 formed in the yellow color and having a tone level of 100%, and a half-toned image segment I2 formed in the same yellow color and having a tone level of 80%, the image segments adjoining each other.

Next, the cyan developer 4C is operated to form a cyan image pattern (Step S32). As shown in FIG. 28, the cyan image pattern includes a cyan half-toned image segment I3 having a tone level of 20%, and a cyan solid image segment I4 adjoining thereto. The half-toned image segment I3 is formed at place to be superimposed with the half-toned image segment I2 of the yellow image pattern. Subsequently, the magenta developer 4M and the black developer 4K are operated, respectively, so as to sequentially form a magenta image pattern consisting of a magenta solid image segment I5 and a black image pattern consisting of a black solid image segment I6 (Steps S33 and S34).

Thus, the test pattern TP is formed on the intermediate transfer belt 71 by superimposing the image patterns of the individual colors. The status sheet is obtained by transferring the test pattern TP to the sheet S (Step S35). The solid image segment I1 of the yellow image pattern formed in the aforementioned manner corresponds to the yellow monochromatic image Iy of the test pattern TP on the status sheet. Likewise, the cyan solid image segment I4 of the cyan image pattern, the magenta image pattern I5 and the black image pattern I6 correspond to the cyan monochromatic image Ic, the magenta monochromatic image Im and the black monochromatic image Ik of the test pattern TP, respectively. On the other hand, the yellow half-toned image segment I2 and the cyan half-toned image segment I3 are superimposed on each other, so as to form the color-mixture image Iyc of the test pattern TP.

It is noted that the image patterns and the order of arranging these image patterns are not limited to the above. In a case where the magenta color is used as the toner color for mixing, in stead of the cyan color, for example, the image patterns of cyan and magenta shown in FIG. 28 may be replaced by each other. In this case, the arrangement of the apparatus is not adapted to change the order of forming the images of the individual toner colors. Accordingly, after the formation of the yellow image pattern, the cyan image pattern may be previously formed at place corresponding to the magenta image pattern shown in FIG. 28. Subsequently, the magenta image pattern may be formed at place corresponding to the cyan image pattern shown in FIG. 28.

As described above, when the residual quantity of the yellow toner is below the reference value, the image forming apparatus of the embodiment outputs, on an as-required basis, the status sheet formed with the test pattern TP including the monochromatic images of the individual toner colors. At this time, the color-mixture image of yellow and another toner color is formed additionally to the monochromatic images in consideration of that the yellow toner color is less visible in monochrome. Thus, the yellow toner image is replaced by the image of a more visible color. Furthermore, the density variations of the yellow toner image appear as the color irregularities in the color-mixture image. As a result, the user can judge the quality of the yellow toner image by evaluating the degree of the color irregularities on the color-mixture image. In this manner, the embodiment even permits the general users having little specialized knowledge to evaluate the image quality easily.

The color-mixture image is defined by the image formed by superimposing the yellow image pattern having the substantially uniform pattern with the cyan image pattern also having the substantially uniform pattern. Hence, the color-mixture image substantially has a consistent color tone across the overall area thereof if the yellow toner image is free from the image defects. Conversely if the yellow toner image sustains the image defects, the color-mixture image contains a portion of a different color tone relative to its peripheral area. Therefore, the user can readily judge the image quality from the result of the visual inspection of the test pattern TP even though the user does not know the original color tone of the test pattern TP nor compare the test pattern with the color sample. Particularly, the toner color for mixing is defined by the color of the toner, the residual quantity of which is more than the reference value so that the near-end message thereof is yet to be displayed. Thus, the density variations of the toner color for mixing are obviated, so that the quality of the image of the yellow color may be evaluated more correctly. Furthermore, not only the color-mixture image but also the monochromatic images of the respective original toner colors of the mixed color are formed, thereby ensuring that the image quality is evaluated more properly.

According to the embodiment as described above, each of the developers 4Y, 4C, 4M, 4K functions as the "toner storage unit" of the invention. The engine EG functions as the "image forming unit" of the invention. In this embodiment, the yellow color is a "to-be-checked toner color" of the invention, whereas the cyan color is a "toner color for mixing" hereof. The image Iyc of the mixture of these colors is equivalent to the "image-quality evaluation image" of the invention. The reference value of the residual toner quantity which is referred to when determining whether the near-end message related to the yellow color is displayed or not is equivalent to "first reference value" of the invention, whereas the reference value of the residual toner quantity which is referred to when determining whether the near-end message related to the cyan or magenta color is displayed or not is equivalent to "second reference value" hereof.

The invention is not limited to the foregoing embodiments and various changes and modifications other than the above may be made thereto so long as such changes and modifications do not deviate from the scope of the invention. According to the fifth embodiment, for example, the status sheet containing the above test pattern TP is outputted when the near-end message is displayed with respect to the yellow toner color. However, the timing of outputting the status sheet is not limited to this. For instance, the status sheet may be outputted irrespective of whether the near-end message is displayed or not, but in response to a demand from the user or the external apparatus. Regardless of the demand from the external apparatus, the status sheet may also be outputted when, for example, the near-end message is displayed with respect to any one of the toner colors.

While the fifth embodiment forms the test pattern TP including the image patterns of all the toner colors, the test pattern is not limited to this. For instance, a test pattern may be formed in only a toner color related to the displayed near-end message, or in only a demanded toner color. In these cases, the color-mixture image of the mixed color of yellow and another toner color may be formed if the toner colors of the test pattern include the yellow color. While the foregoing description is made by way of the example where the yellow color is the "to-be-checked toner color", the same holds for the other toner colors.

While the fifth embodiment defines the mixing ratio of yellow (to-be-checked toner color) and cyan (toner color for mixing) of the color-mixture image Iyc as 80%:20%, the ratio is not limited to the above value but is arbitrary. It is noted however that if the mixing ratio of cyan is too small, the effect to enhance the visibility is decreased. If the mixing ratio of the toner color for mixing is too great, the to-be-checked toner color has such a small influence on the color tone of the resultant color-mixture image that it is difficult to evaluate the image quality on the to-be-checked toner color. It is therefore preferred to use the toner of the color for mixing in a ratio of 50% or less in the color-mixture image for checking of the image quality.

In the fifth embodiment, the color-mixture image Iyc, as the image-quality evaluation image, is formed by superimposing the respective half-toned images of yellow (to-be-checked toner color) and cyan (toner color for mixing). An alternative image-quality evaluation image may be formed, for example, by superimposing a yellow solid image and a cyan half-toned image.

While the fifth embodiment forms a set of test pattern on the status sheet, plural sets of test patterns may be formed. In the light of the fact that the eccentricity or flexure of the cylindrical photosensitive member 22 or developing roller 44 tends to cause the image density variations along the axial direction thereof, for example, the test patterns may be formed at plural places along the axial direction, as illustrated as below.

Figure 29:
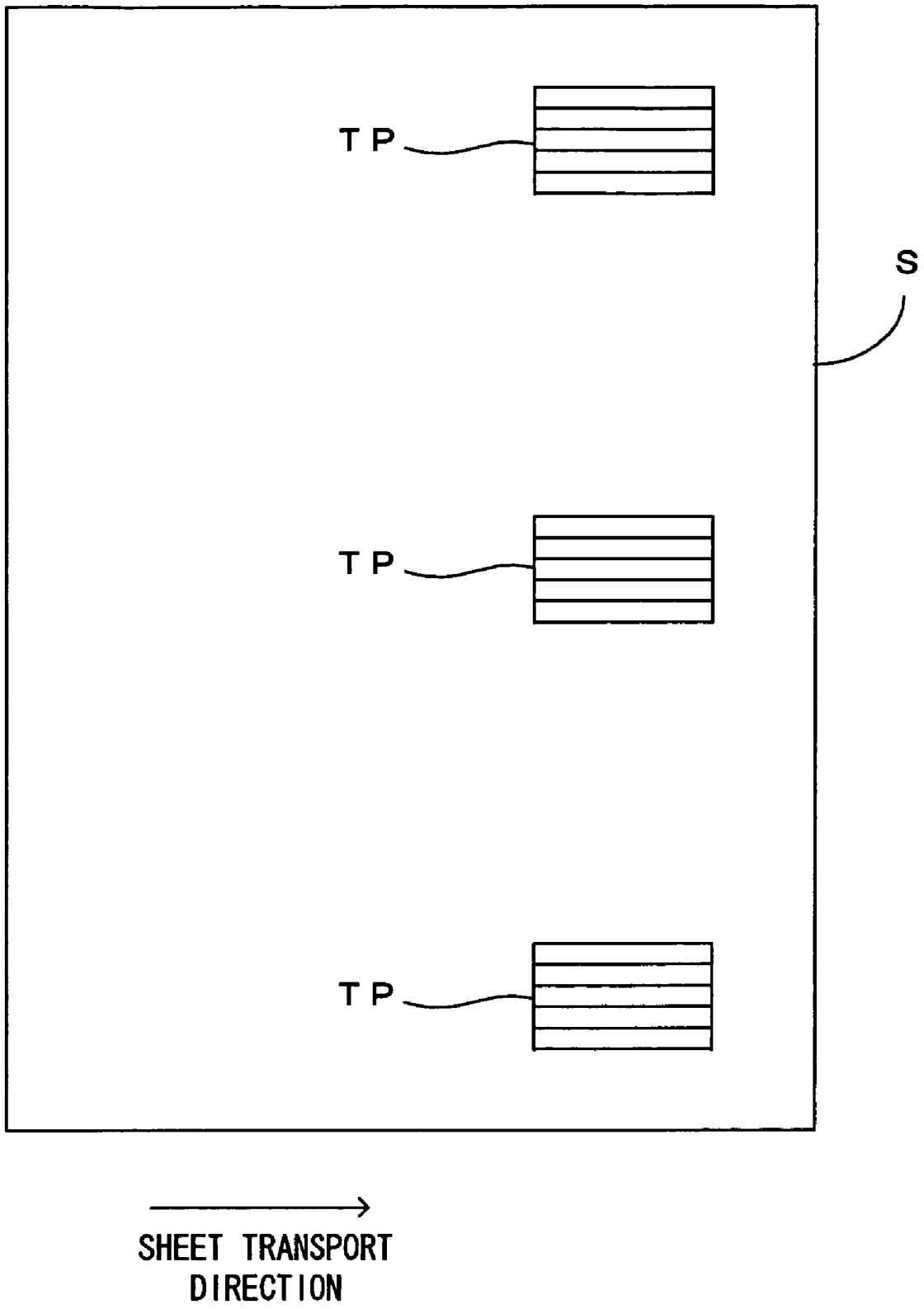
FIG. 29 is a diagram showing another example of the status sheet in the fifth embodiment.

FIG. 29 is a diagram showing another example of the status sheet in the fifth embodiment. In this example, three sets of test patterns TP are formed along the direction perpendicular to the sheet transport direction or the axial direction of the photosensitive member 22 and developing roller 44. In this manner, the test patterns TP are formed at places located along the axial direction of the photosensitive member 22 and developing roller 44 and in correspondence to the center and opposite ends thereof, thereby ensuring that even if the image quality is varied from place to place due to the eccentricity or flexure of the photosensitive member 22 or developing roller 44, the image quality is evaluated correctly without overlooking such image quality variations.

<Other Features>

While the above first to fifth embodiments apply the invention to the image forming apparatus for forming images by using the four color toners of yellow, magenta, cyan and black, the types and the number of toner colors are not limited to the above but are arbitrary. The invention may be applied not only to the apparatuses of the rotary development system as illustrated by the embodiments, but also to so-called tandem-type image forming apparatuses wherein the developers corresponding to the individual toner colors are arranged in a line along the sheet transport direction. In addition, the invention is applicable not only to the electrophotographic apparatuses as illustrated by the foregoing embodiments but also to the all kinds of image forming apparatuses using the toner.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

a toner storage unit which stores a toner therein;

a toner carrier which revolvingly moves in a predetermined direction as carrying thereon the toner supplied from the toner storage unit, thereby transporting the toner; and an image forming unit which forms an image-quality evaluation image on a recording medium by using the toner carried on the toner carrier and outputs the recording medium as a status sheet for checking image quality by a user, wherein the image forming unit forms the image-quality evaluation image which includes an evaluative image segment formed using the toner carried on a region of a surface of the toner carrier, the region having the toner thereon consumed for image formation in the immediately preceding revolution of the toner carrier, the image-quality evaluation image further includes a reference image segment which is formed using the toner carried on a region of the surface of the toner carrier, the region holding the toner unconsumed for image formation in the immediately preceding revolution of the toner carrier, the image-quality evaluation image is formed in a manner that the evaluative image segment and the reference image segment adjoin each other, and the image-quality evaluation image has an arrangement wherein the evaluative image segment adjoins the reference image segment on the overall periphery thereof.

2. An image forming apparatus comprising:

a toner storage unit which stores a toner therein:

a toner carrier which revolvingly moves in a predetermined direction as carrying thereon the toner supplied from the toner storage unit, thereby transporting the toner; and an image forming unit which forms an image-quality evaluation image on a recording medium by using the toner carried on the toner carrier and outputs the recording medium as a status sheet for checking image Quality by a user, wherein the image forming unit forms the image-Quality evaluation image which includes an evaluative image segment formed using the toner carried on a region of a surface of the toner carrier, the region having the toner thereon consumed for image formation in the immediately preceding revolution of the toner carrier, the image-quality evaluation image further includes a reference image segment which is formed using the toner carried on a region of the surface of the toner carrier, the region holding the toner unconsumed for image formation in the immediately preceding revolution of the toner carrier, the image forming unit is capable of forming images on the both sides of the recording medium, the image forming unit forms, as the reference image segment of the image-quality evaluation image, a first reference image segment on a first primary side of the recording medium and a second reference image segment on the other primary side of the recording medium at place corresponding to the first reference image segment, by using the toner carried on a surface region of the toner carrier, the region holding the toner unconsumed for image formation in the immediately preceding revolution of the toner carrier, and the image forming unit forms, as the evaluative image segment of the image-quality evaluation image, a first evaluative image segment on the first primary side of the recording medium and a second evaluative image segment on the other primary side of the recording medium at place corresponding to the first evaluative image segment, by using the toner carried on a surface region of the toner carrier, the region having the toner thereon consumed for image formation in the immediately preceding revolution of the toner carrier.

3. An image forming apparatus according to claim 2, wherein the image-quality evaluation image is formed in a manner that the first reference image segment and the first evaluative image segment adjoin each other whereas the second reference image segment and the second evaluative image segment adjoin each other.

4. An image forming apparatus according to claim 1, wherein the image forming unit forms the image-quality evaluation image on an as-required basis when a residual quantity of toner in the toner storage unit is below a predetermined reference value.

5. An image forming apparatus according to claim 1, further comprising the plural toner storage units respectively corresponding to mutually different toner colors, wherein the reference image segment and the evaluative image segment are both formed in the same toner color.

6. An image forming apparatus comprising:

an image carrier designed to carry an image formed of a toner;

a toner storage unit for storing the toner;

a toner carrier which revolvingly moves in a predetermined direction as carrying thereon the toner supplied from the toner storage unit, thereby transporting the toner to an opposed position to the image carrier; and an image forming unit which forms an image on the image carrier at the opposed position by transferring the toner from the toner carrier to the image carrier, wherein on an as-required basis the image forming unit forms an image-quality evaluation image on a recording medium and outputs the recording medium as a status sheet for checking image quality by a user, the image-quality evaluation image including; a band-like pattern which has a uniform image pattern extending along the moving direction of a surface of the toner carrier with respect to the opposed position; and scale-mark patterns arranged near the band-like pattern as spaced at predetermined space intervals along the moving direction, a length of the band-like pattern along the moving direction is equal to or greater than a length equivalent to a circumferential length of the toner carrier, and the space interval between the scale-mark patterns is equal to the length equivalent to the circumferential length of the toner carrier.

7. An image forming apparatus according to claim 6, further comprising a toner supply member disposed in the toner storage unit and rotated as abutted against the toner carrier thereby supplying a predetermined quantity of toner to the toner carrier, wherein a length of the band-like pattern along the moving direction is equal to or greater than a length equivalent to a circumferential length of the toner supply member.

8. An image forming apparatus according to claim 7, wherein the space interval between the scale-mark patterns is equal to the length equivalent to the circumferential length of the toner supply member.

9. An image forming apparatus according to claim 6, wherein the image carrier is an endless revolving body which revolves in a predetermined direction, whereas a length of the band-like pattern along the moving direction is equal to or greater than a length equivalent to a circumferential length of the image carrier.

10. An image forming apparatus according to claim 6 wherein the image-quality evaluation image includes the plural band-like patterns formed at different places shifted along a direction perpendicular to the moving direction.

11. An image forming apparatus according to claim 6, further comprising the plural toner storage units, wherein the image forming unit forms the band-like pattern corresponding to each of the plural toner storage units using the toner stored in the corresponding toner storage unit.

12. An image forming apparatus according to claim 11, wherein the image forming unit forms the scale-mark patterns using a toner stored in one of the plural toner storage units, that contains the toner in the greatest residual quantity.

13. An image forming apparatus according to claim 11, wherein the image forming unit forms the scale-mark patterns using respective toners stored in at least two of the plural toner storage units, and the scale-mark patterns formed using the respective toners are superimposed on each other.

14. A method of forming an image-quality evaluation image for image-quality evaluation purpose on a recording medium in an image forming apparatus in which a toner carrier revolvingly moves in a predetermined direction as carrying thereon a toner thereby transporting the toner, the method comprising the steps of:

performing an image forming operation by using the toner carried on the toner carrier in a first revolution of the toner carrier, thereby consuming the toner carried on a predetermined region of a surface of the toner carrier, forming at least a part of the image-quality evaluation image, the image-quality evaluation image including an evaluative image segment that adjoins a reference image segment on the overall periphery thereof, by using the toner carried on the predetermined surface region of the toner carrier in a second revolution following the first revolution of the toner carrier; and outputting a recording medium on which the image-quality evaluation image is formed as a status sheet for checking image quality by a user.

15. A method of forming an image-quality evaluation image for image-quality evaluation purpose on a recording medium in an image forming apparatus in which an image carrier designed to carry an image formed of a toner is disposed in opposed relation with a toner carrier performing a revolving movement in a predetermined direction as carrying, on its surface, the toner supplied from a toner storage unit and an image is formed on the image carrier by transferring the toner from the toner carrier to the image carrier, the method comprising the step of:

forming the image-quality evaluation image which includes a band-like pattern and scale-mark patterns; and outputting the recording medium on which the image-quality evaluation image is formed as a status sheet for checking image quality by a user, wherein the band-like pattern has a uniform image pattern extending along the moving direction of a surface of the toner carrier with respect to the opposed position, a length of the band-like pattern along the moving direction is equal to or greater than a length equivalent to a circumferential length of the toner carrier.

the scale-mark patterns are formed near the band-like pattern at predetermined space intervals along the moving direction and the space interval between the scale-mark patterns is equal to the length equivalent to the circumferential length of the toner carrier.

* * * * *